US008590540B2

(12) United States Patent
Kahn, III

(10) Patent No.: US 8,590,540 B2
(45) Date of Patent: Nov. 26, 2013

(54) SMOKING PIPE APPARATUS

(76) Inventor: Harry Dante Kahn, III, Westminster, CO (US)

( * ) Notice: Subject to any disclaimer, the term of this patent is extended or adjusted under 35 U.S.C. 154(b) by 116 days.

(21) Appl. No.: 13/368,335

(22) Filed: Feb. 8, 2012

(65) Prior Publication Data

US 2013/0199546 A1 Aug. 8, 2013

(51) Int. Cl.
*A24F 1/10* (2006.01)
*A24F 5/00* (2006.01)

(52) U.S. Cl.
USPC ..... 131/226; 131/176; 131/178; 131/180; 131/216

(58) Field of Classification Search
USPC ..... 131/176, 180, 184.2, 196, 197, 213, 131/216, 218, 226
See application file for complete search history.

(56) References Cited

U.S. PATENT DOCUMENTS 3,863,647 A * 2/1975 Unger ..... 131/179
4,080,972 A 3/1978 Furlow
4,223,687 A 9/1980 Sandeen
4,252,135 A 2/1981 Herman
4,484,590 A 11/1984 Singh
5,832,935 A 11/1998 Heine
7,658,197 B1 2/2010 Villagomez
7,694,685 B1 4/2010 Jones
7,753,055 B2 7/2010 Bryman
2008/0121244 A1 * 5/2008 Bryman et al. ..... 131/328

* cited by examiner

*Primary Examiner* — Richard Crispino
*Assistant Examiner* — Eric Yaary
(74) *Attorney, Agent, or Firm* — Roger A. Jackson

(57) ABSTRACT

A smoking pipe apparatus includes an elongated body having a first end, a second end, a base, a primary side, a first margin, and a second margin. Also, a bowl including a sidewall extending from a step that terminates at the primary side, the bowl includes multiple voids that are disposed inward from the step toward the base. The voids inwardly terminate at a central ridge located inward from the step toward the base wherein the ridge is extended toward the primary side between the step and the voids. Also, passageways are within the body extending from the voids. A screen that is supported on an outer periphery by the step and centrally on the ridge, the screen is concave from the primary side. Operationally, tobacco is ignited in the screen concave area, a diffusion of smoke is created in the voids for an outward omnidirectional burn of the tobacco.

8 Claims, 22 Drawing Sheets

SMOKING PIPE APPARATUS

RELATED APPLICATIONS

There are no related applications.

TECHNICAL FIELD

The present invention relates to smoking pipes, and more specifically to a tobacco smoker's pipe apparatus having a bowl venting chamber void, an elevated screen support ridge, a plurality of smoke passage ways, in addition to multiple storage chambers for extra tobacco and cleaning supplies, and a removable and adjustable tool that acts as a bowl cover and a wind guard when inserted into the pipe.

BACKGROUND OF INVENTION

In looking at the prior art starting with U.S. Pat. No. 7,753,055 to Bryman disclosed is an integrated smoking device for smoking material comprising: a housing, a bowl, with the bowl contained within the housing; the bowl further comprising a top part and a bottom part, the top part being approximately circular, and the bottom part being circular. The bowl in Bryman having the top part being larger in area than the bottom part, wherein the top part is generally parallel to the bottom part and the center of the top part is approximately centered over the bottom part, and bowl walls connecting the top part and the bottom part. Thus in Bryman the top part and the bottom part are fully contained within the housing wherein the bowl further comprises a first bowl aperture, a second bowl aperture, and a third bowl aperture; and a first tube, a second tube, and a third tube. In Bryman the first tube, the second tube, and the third tube are all substantially contained within the housing, wherein the bowl further comprises a movable cover associated with the housing for opening and closing over the top part of the bowl. In Bryman, a third tube is for transporting smoke from the ignited smoking material; the third tube is mechanically connected to the third bowl aperture to a user; further, a gas source substantially contained within the housing is connected to a second tube, the second tube is connected to the second bowl aperture; and a gas source, with the gas source substantially contained within the housing. Also in Bryman, a spark source is disclosed with the spark source substantially contained within the bowl, the spark source capable of emitting a spark, such that the spark source is capable of igniting the gas source and the spark source is mechanically connected to the first bowl aperture by the first tube. Wherein, when the switch is depressed in Bryman the gas flows from the gas source and the gas is ignited by the spark source, so that the smoking material ignites and the smoke emitted from the smoking material may be drawn through the third tube by the user. Note that Bryman does not teach any unique bowl configuration with an elevated ridge or a plurality of smoke passageways for omnidirectional smoking material burning in the bowl interior, as Bryman is essentially a combination standard pipe with an integral lighter assembly.

Continuing in the prior art, being similar to Bryman, is U.S. Pat. No. 7,694,685 to Jones that discloses a smoking pipe comprising an elongated body with a bowl cavity formed on one end in which a bowl assembly is disposed. Further in Jones located inside the elongated body is a gas lighter with an activation switch and flame opening located on one end. The lighter in Jones is positioned in the elongated body so that the flame opening is located adjacent to the upper bowl on the bowl assembly and its activation switch is near the lower neck section. Formed over the bowl in Jones are air openings which allow outside air to enter the bowl and pivotally attached to the neck section on the bowl assembly is an elongated mouthpiece. The mouthpiece in Jones includes a wide head and a narrow arm component with a longitudinally aligned conduit formed therein that communicates with an air passageway formed on the bow assembly, wherein a cam surface is formed on the head which presses against a plunger arm when the mouthpiece is rotated to a perpendicularly aligned position on the elongated body, and when the plunger arm is pressed against the activation switch on the lighter a flame in created that extends into the bowl, automatically igniting the smoking material. The mouthpiece in Jones allows smoke to be drawn when it is in the perpendicular state and when the mouthpiece is placed in a closed or non-perpendicular state, smoke cannot be drawn therethrough the mouthpiece. Note that in Jones as in Bryman also, neither does not teach any unique bowl configuration with an elevated ridge or a plurality of smoke passageways for omnidirectional smoking material burning in the bowl interior, as Jones is essentially a combination pipe having an integral lighter assembly similar to Bryman.

Further, in the prior art in U.S. Pat. No. 7,658,197 to Villagomez disclosed is a smoking pipe having a cleaning valve that includes a pipe body with an internal bore. A combustion chamber in Villagomez is communicably connected with the bore, with a cleaning valve being mounted adjustably within the bore. The valve in Villagomez includes a longitudinal channel and the valve alternates between a first position state, see FIGS. 1-6, wherein the channel is communicably interconnected to an orifice in a mouthpiece of the pipe and the combustion chamber and a second position state wherein the channel is fully exposed so that it may be quickly and completely cleaned, see FIG. 12. Note that in Jones, Bryman, and Villagomez all of which do not teach any unique bowl configuration with an elevated ridge or a plurality of smoke passageways for omnidirectional smoking material burning in the bowl interior, as Villagomez is essentially a rotating inner channel that can be exposed for cleaning.

Next, in the prior art in U.S. Pat. No. 5,832,935 to Heine disclosed is a tobacco storage and smoking apparatus that includes a housing having a first chamber which receives smoking materials such as tobacco and is covered by a cover including a bowl recess with a side passageway extending from the bowl recess to one end of the cover. The housing in Heine has a second chamber on an opposite side of the housing from the first chamber removably containing a stem having a through passageway and intended to be assembled to the cover to create a smoking pipe. The second chamber in Heine is downwardly open and may be closed by a further cover and if desired, the second chamber may contain a spring recess partially receiving a coil spring which biases the stem toward a direction of removal from the second chamber. Further, in Jones, Bryman, Villagomez, and Heine all of which do not teach any unique bowl configuration with an elevated ridge or a plurality of smoke passageways for omnidirectional smoking material burning in the bowl interior, as Heine is essentially a sliding cover with a storage chamber 13, see FIG. 5, for moving the tobacco into the bowl 21, however, there being no teaching in Heine that shows use of the housing 11 as a bowl 21 cover for controlling air flow to the bowl.

Moving onward in the prior art, in U.S. Pat. No. 4,484,590 to Singh disclosed is a pipe comprising: a body member means including a smoke drawing passageway; a mouthpiece connected to the smoke drawing passageway; a storage compartment adjacent the smoke drawing passageway; and a filler opening leading from the storage compartment; and tobacco burning means including a slide member having a means for sliding exclusively in a rectalinear fashion. The tobacco burning means in Singh having a bowl in a slidable engagement with the body member means; and a plurality of position indicators on the slide member; wherein the bowl is slidably positionable to access the smoke drawing passageway and the filler opening from the storage compartment. Thus, Singh teaches integral tobacco storage with the pipe as does Heine, with Singh having the added feature of a vented bowl cover 49, see FIGS. 2 and 3, for retaining the tobacco in the bowl 11, wherein the smoke in drawn through passage 13. There is no teaching in Singh of an elevated ridge or a plurality of smoke passageways for omnidirectional smoking material burning in the bowl interior.

Next in the prior art in U.S. Pat. No. 4,080,972 to Furlow discloses is a pipe having an internal storage chamber formed from a single block of wood, wherein a sliding peg located in the passageway allows the feeding of tobacco into the bowl and modulating the air mixture for cooler smoking. Looking at Furlow in FIGS. 5 and 7, the tobacco storage 9 connects to the bowl 2 through channel 10, with passageway 3 allowing smoke to be drawn for the user. The peg 15 in Furlow facilitates added air flow to the bowl 2 as between the storage 9 and the channel 6, however this being of minimal effect as the opening at the top of the bowl 2 being much larger in diameter and shorter in length would overwhelmingly predominate the air flow to the bowl 2. In Furlow the intersection of the passageway (stem hole) 3 and the bowl 2 bottom 4 is taught as "forming a direct passage to the bottom 4 of the bowl 2, see column 2, lines 1-7, thus no structural specifics are taught in Furlow of an elevated ridge or a plurality of smoke passageways for omnidirectional smoking material burning in the bowl interior.

Continuing, in the prior art in U.S. Pat. No. 4,223,687 to Sandeen disclosed is a combination pipe and lighter having a mouthpiece that is swingable from an operative position to an inoperative position in which a supply of smoking material can be selectively placed directly into the smoking bowl, with the lighter adjacent to the bowl, also having a hinged cover to snuff out the lighter while allowing ventilated air to the bowl much like Singh with a ventilated bowl cover. The storage of smoking product in Sandeen is in chamber 13 in the cover that feeds downward into the bowl. Thus, no structural specifics are taught in Sandeen of an elevated ridge or a plurality of smoke passageways for omnidirectional smoking material burning in the bowl interior.

Next, in the prior art in U.S. Pat. No. 4,252,135 to Herman disclosed is a smoking apparatus having differing volumes of available bowl capacity that is accomplished through various size bowl inserts, further a cleaning access is provided in the bottom of the bowl, with an added chamber for smoking material storage, and a pivoting bowl cover to selectively control air flow to the bowl. Although Herman teaches a plurality of openings 32 emanating from the bowl, there is no teaching of an elevated ridge providing for omnidirectional smoking material burning in the bowl interior with an air gap disposed underneath a screen, especially as Herman has no screen.

What is need is a smoker's pipe apparatus that accommodates free and open omnidirectional smoking material burning in the bowl interior, easy access storage chambers for smoking material, screens, cleaners, and a removable tool that serves both the function of bowl cover and bowl wind guard for lighting the pipe in a windy environment, and in addition a tool extension for cleaning, accessing storage compartments, and stifling tobacco. Further needed in the smoker's pipe apparatus is a bowl bottom specifically designed to keep a screen from conforming to the shape of the bottom of the bowl and allow air to pull downward through the entire bottom area of the screen for a more even burn and smoother air flow, wherein an air space open chamber is formed below the screen to prevent "hot spots" of smoking material to burn while other portions of the bowl smoking material do not burn well or at all.

SUMMARY OF INVENTION

Broadly the present invention is a smoking pipe apparatus for smoking tobacco that includes an elongated body having a longitudinal axis, the elongated body including a first end portion and an opposing second end portion, the elongated body also including a base portion side and an opposing primary portion side, further the elongated body includes a first margin and an opposing second margin. Further included in the smoking pipe apparatus is a bowl disposed partially within the first end portion from the primary portion side, the bowl including a surrounding sidewall that extends from a step and terminates at the primary portion side, wherein the sidewall defines a bowl interior separated from an exterior environment, the bowl also includes a plurality of chamber voids that are disposed inward from the step toward the base portion side. Wherein the plurality of chamber voids inwardly terminate at a centrally disposed ridge that is positioned inward from the step toward the base portion side, wherein the ridge is extended toward the primary portion side being positioned between the step and the chamber voids.

Also included in the smoking pipe apparatus is a plurality of passageways extending from the second end portion to the plurality of chamber voids, wherein the plurality of passageways are disposed within the elongated lower body, each of the passageways is in fluid communication with each of the chamber voids. In addition, the smoking pipe apparatus includes a screen that is disposed within the sidewall, wherein the screen is supported on an outer periphery by the step and the screen is centrally supported by the ridge, wherein the screen assumes a concave shape as viewed from the primary portion side. Wherein operationally in the smoking pipe apparatus when tobacco is placed within the screen concave shape and with an activation of a lighter from the primary portion side adjacent to the tobacco and simultaneously with a manual creation of a vacuum at the plurality of passageways on the second end portion, a diffusion of tobacco smoke is created with the plurality of chamber voids to result in a more centrally outward omnidirectional burn of the tobacco.

An object is to provide a compact smoking pipe apparatus with a lockable cover for the bowl, the bowl cover being pivotally opened to an open positional state, and is operable as a wind-guard to aid in igniting the tobacco. The wind-guard is connected to a poker tool which extends into and is received by the distal end portion of the elongated ancillary body of the smoking pipe apparatus. When the wind-guard is positioned perpendicular to the free portion side of the elongated ancillary body, the tobacco in the bowl may be ignited while drawing air through the passageways to the mouthpiece. After the tobacco is ignited, the burn rate can be variably controlled by partially closing the bowl cover over the bowl. When the bowl cover is completely closed after igniting the tobacco for consumption, it will extinguish the burning tobacco rapidly to save tobacco.

A further object of the smoking pipe apparatus is to provide a compact smoking pipe apparatus in which a main storage compartment and the smoking bowl are separated by a lockable pivoting gate which, when in the closed state being adjacent to the main storage compartment, becomes both the rear wall of the bowl area and the front wall of the main storage compartment. A pivotally hinged compartment cover functions as a closure for the main storage compartment, and the compartment cover front edge meets the rear edge of the gate in the closed state. A locking system keeps the pivoted compartment cover in the closed positional state. The gate is also locked in the closed positional state by the poker tool which is attached to the bowl cover. The tobacco can be moved from the main storage compartment to the bowl area for consumption when the gate is in the open positional state by pivoting away from the main storage compartment using gravity or centrifugal force via removing the bowl cover first from the elongated ancillary body. The side of the removable bowl cover and poker tool combination is also used to move tobacco from the main storage compartment to the bowl. The pivotal gate has a portion of its lower edge that is adjacent to the main storage compartment that is sharpened to cut off any tobacco which may be caught underneath it upon it being placed into the closed positional state.

A further object of the smoking pipe apparatus is to provide structure for positioning a screen in the smoking bowl in which it is held away from the bottom of the bowl to aid in airflow and minimize clogging of the pipe. A rapid stepping down of the bowl diameter near the bottom of the bowl accomplishes this goal by keeping the screen from becoming pressed against the bowl bottom over time via the screen resting upon a bowl side step on an outer periphery of the screen, wherein a vent chamber void is formed around the screen opposite of the tobacco. Multiple smoke conveying passageways extend from underneath the screen in the vent chamber to the mouthpiece for drawing air and thereby smoking the tobacco in an even and omnidirectional manner within the bowl.

Another object of the smoking pipe apparatus is to have a poker rod tool connected to the wind-guard/bowl cover as a removable tool for cleaning the passageways, stifling the tobacco, and manipulating other aperture openings.

A yet further object of the smoking pipe apparatus is to provide multiple additional storage areas for cleaning supplies and extra screens to be positioned in the bowl after each cleaning.

An added object of the smoking pipe apparatus is to provide a completely enclosed/self-locked smoking system containing the supplies needed for smoking safely.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
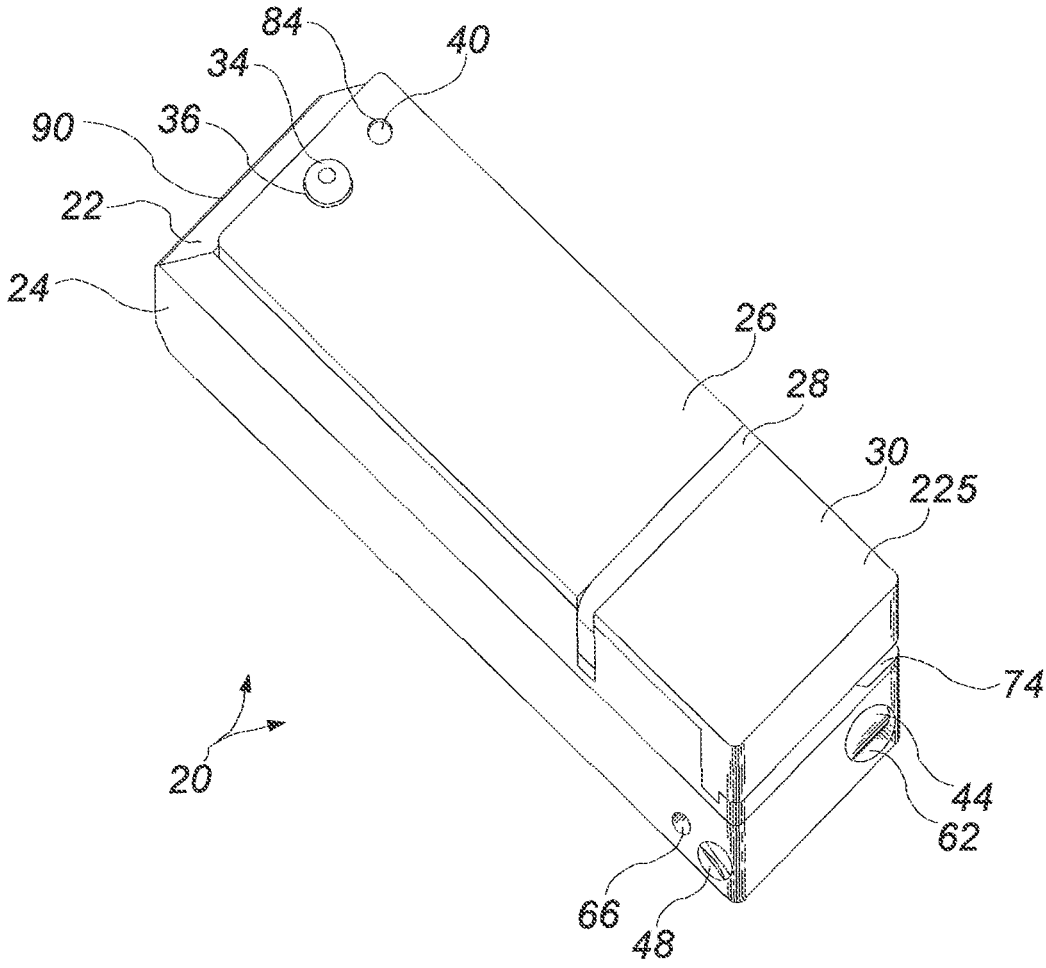
FIG. 1 is a perspective view of the smoking pipe apparatus in a completely assembled operational state.

20 Smoking pipe apparatus
22 Elongated ancillary body
24 Elongated body
26 Compartment cover
28 Gate
30 Bowl cover wind-guard
32 Poker rod/tool
34 Compartment cover pivotal hinge screw
36 Washer
38 Gate hinge pin
40 Compartment cover lock spring loaded detent ball
42 Bowl cover lock spring loaded detent ball
44 Plunger
46 Means for urging the plunger 44 toward the secondary compartment 62 wherein the means 46 is in the form of a spring
48 Plug screw
50 Elongated aperture for the plunger 44 access slot
52 Recess in the plunger
54 Bowl surrounding sidewall
56 Bowl center ridge
57 Bowl vent chamber void
58 Bowl side step
59 Bowl interior
60 Air passageways
62 Secondary storage compartment
64 Main storage compartment
66 Carburetor vent
68 Screen storage area
70 Storage chamber floor depression
72 Front body ridge
74 Cutout in front ridge
76 Front body valley
78 Bowl cover lower ridge
80 Side step
82 Bowl cover lock indentation
84 Compartment cover lock hole
86 Cigarette
88 Pipe cleaner storage slot
90 Mouthpiece
92 Screen
93 Outer periphery of screen 92
94 Tool or poker rod receiving hole
96 Gate lock hole
98 Tobacco
100 Compartment cover hinge hole
102 Compartment cover lock plunger cavity
104 Gate hinge hole
106 Bowl cover lock plunger cavity
108 Poker rod attachment cavity
110 Compartment cover hinge hole
112 Plunger cavity
114 Lower body attachment screws
116 Compartment cover lock indentation
120 Flame
125 Lighter
130 Smoke diffusion
135 Longitudinal axis of the elongated body 24
140 First end portion of the elongated body 24
145 Second end portion of the elongated body 24
150 Base side portion of the elongated body 24
155 Primary side portion of the elongated body 24 forming a mating interface to the mating portion side 175 of the elongated ancillary body 22
160 Exterior environment
164 Long axis of the elongated ancillary body 22
165 Distal end portion of the elongated ancillary body 22
170 Proximal end portion of the elongated ancillary body 22
175 Mating portion side of the elongated ancillary body 22
180 Free portion side of the elongated ancillary body 22
185 First margin of the elongated body 24
190 Second margin of the elongated body 24
194 Pivotal attachment of the gate 28
195 Closed state of the gate 28
196 Pivotal movement of the gate 28 from the closed state 195 to the open state 200
200 Open state of the gate 28
205 Sliding axis of the plunger 44
209 Pivotal attachment of the tool 32 and the cover 30
210 Pivotal axis of the tool 32 and the cover 30
211 Pivotal arc of approximately ninety (90) degrees about the pivotal axis 210
215 Axial movement of the cover 30 along the pivotal axis 215

220 Area opening as between the bowl 54 and the exterior environment 160

225 Closed operational state of the cover 30

230 Open operational state of the cover 30 that can function as a wind guard

235 Cover 30 is sized and configured to slidably engage 240 the main storage compartment 64

240 Slidably engaging of the cover 30 to the main storage compartment 64 to move tobacco 98

245 Movement of the slidable engagement 240

DETAILED DESCRIPTION

Figure 2:
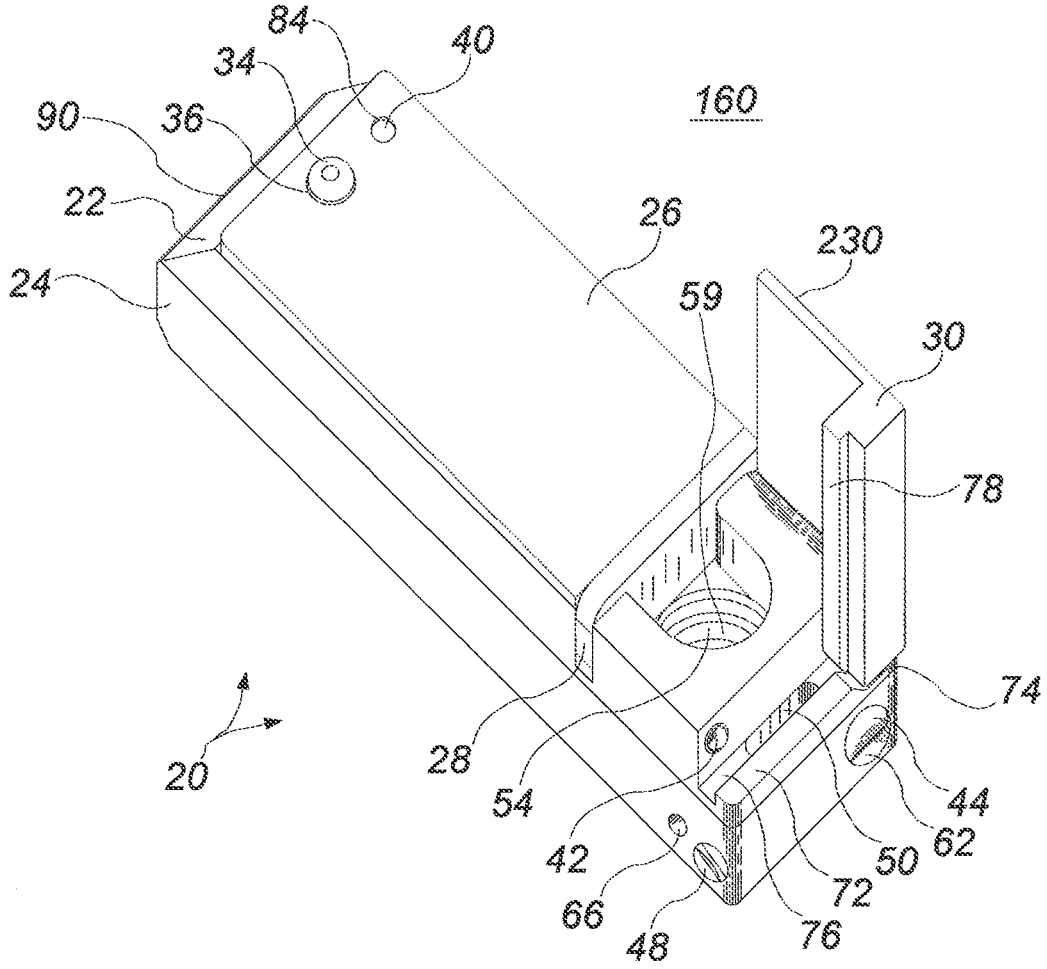
FIG. 2 is a perspective view of the smoking pipe apparatus from FIG. 1, with the bowl cover pivoted open, with the bowl cover functioning as a wind guard for the bowl.
Figure 3:
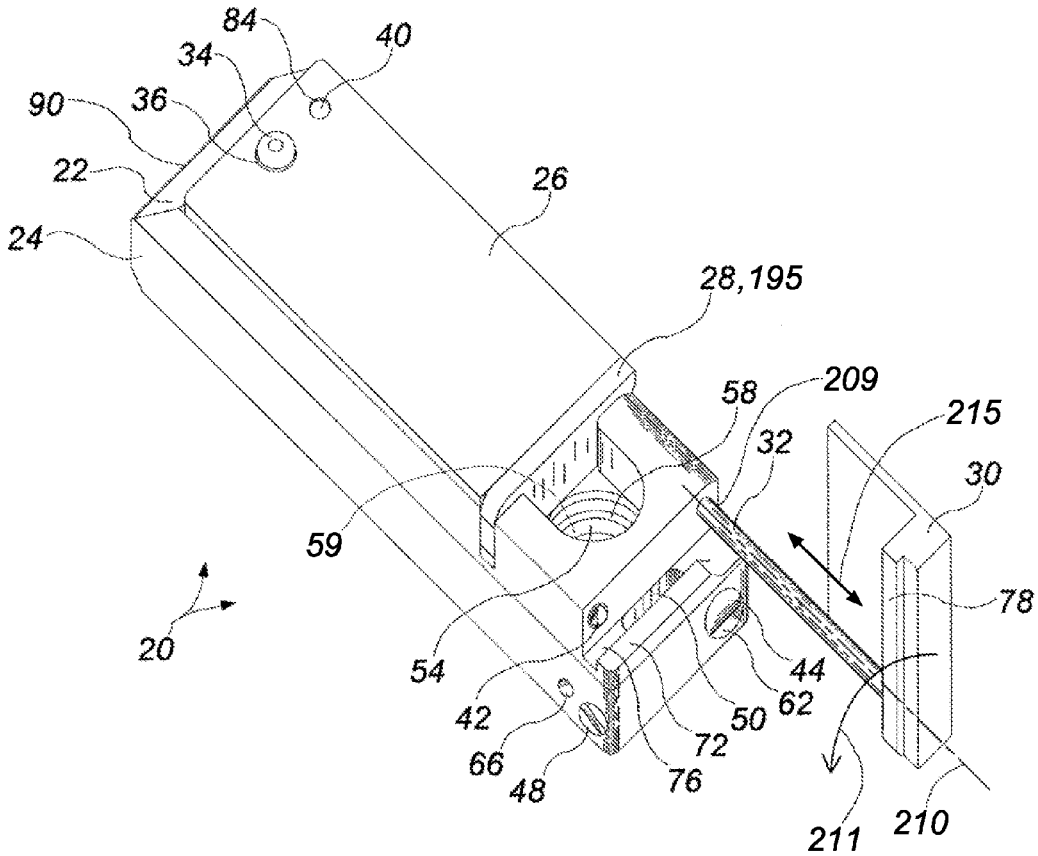
FIG. 3 is a perspective view of the smoking pipe apparatus from FIG. 1, with the bowl cover pivoted open, with the bowl cover being removed away from the smoking pipe apparatus along its pivotal axis.
Figure 4:
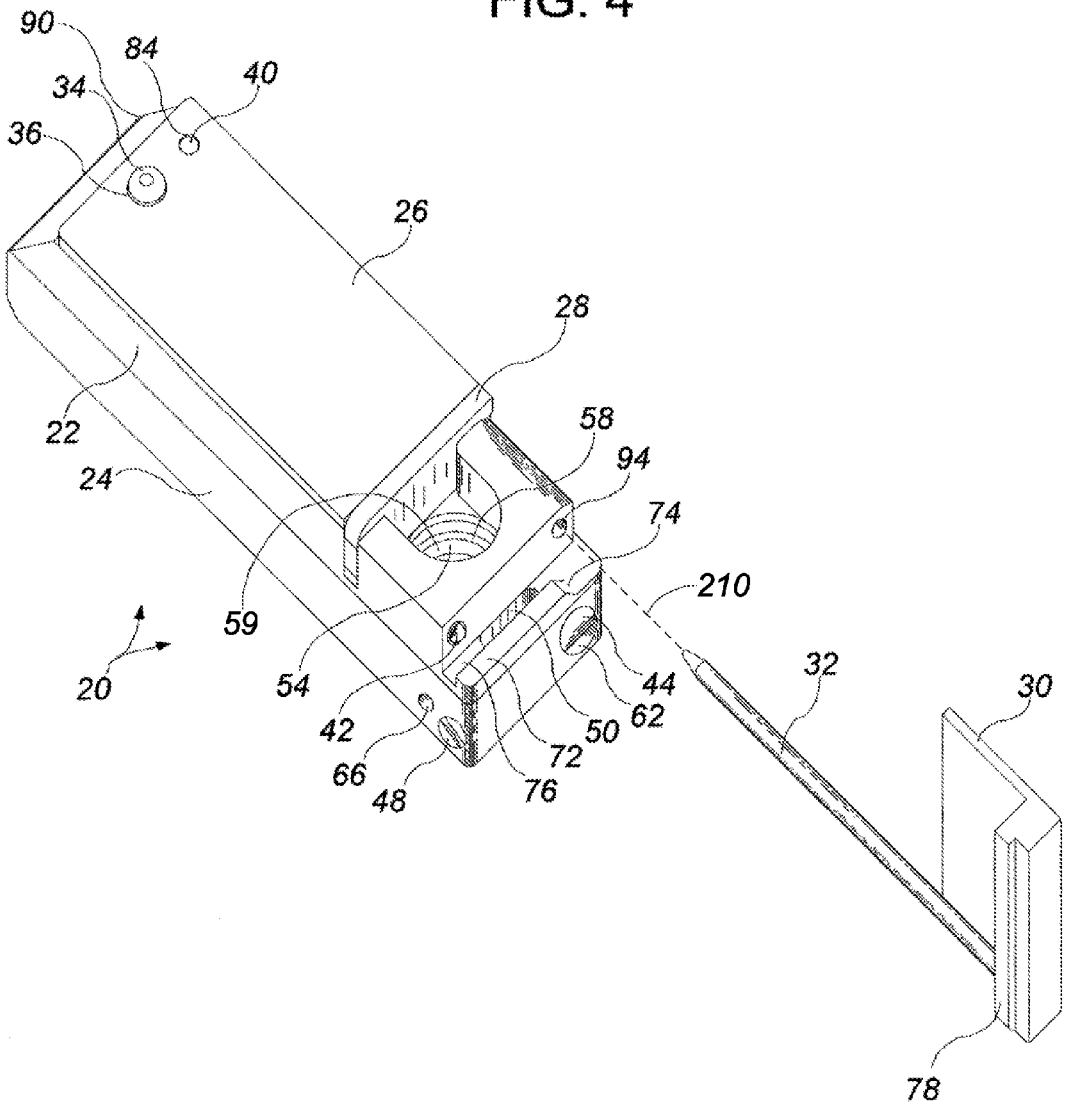
FIG. 4 is a perspective view of the smoking pipe apparatus from FIG. 3, with the bowl cover pivoted open, with the bowl cover being completely removed away from the smoking pipe apparatus along its pivotal axis.

With initial reference to FIG. 1 shown is a perspective view of the smoking pipe apparatus 20 in a completely assembled operational state. Next, FIG. 2 is a perspective view of the smoking pipe apparatus 20 from FIG. 1, with the bowl cover 30 pivoted 211 open, with the bowl cover 30 functioning as a wind guard for the bowl. FIG. 2 also shows a front body ridge 72 and front body valley 76 that help to lock the bowl cover 30 in the closed operational state 225, as shown in FIG. 1, via an interface between a bowl cover lock spring loaded detent ball 42 and a bowl cover lock indentation 82 that is held in place by the front body ridge 72 and a bowl cover lower ridge 78. Further, FIG. 3 is a perspective view of the smoking pipe apparatus 20 from FIG. 1, with the bowl cover 30 pivoted 211 open about a pivotal axis 210, with the bowl cover 30 being removed 215 away from the smoking pipe apparatus 20 along its pivotal axis 210. Continuing, FIG. 4 is a perspective view of the smoking pipe apparatus 20 from FIG. 3, with the bowl cover 30 pivoted 211 open, with the bowl cover 30 being completely removed away from the smoking pipe apparatus 20 along its pivotal axis 210. Also shown in FIG. 4, is a front ridge cutout 74 that facilitates clearance to allow pivotal movement 211 as shown in FIG. 3 for the bowl cover 30 to go from the open state 230, shown in FIG. 2 to the closed state 225, as shown in FIG. 1, and vice versa.

Figure 5:
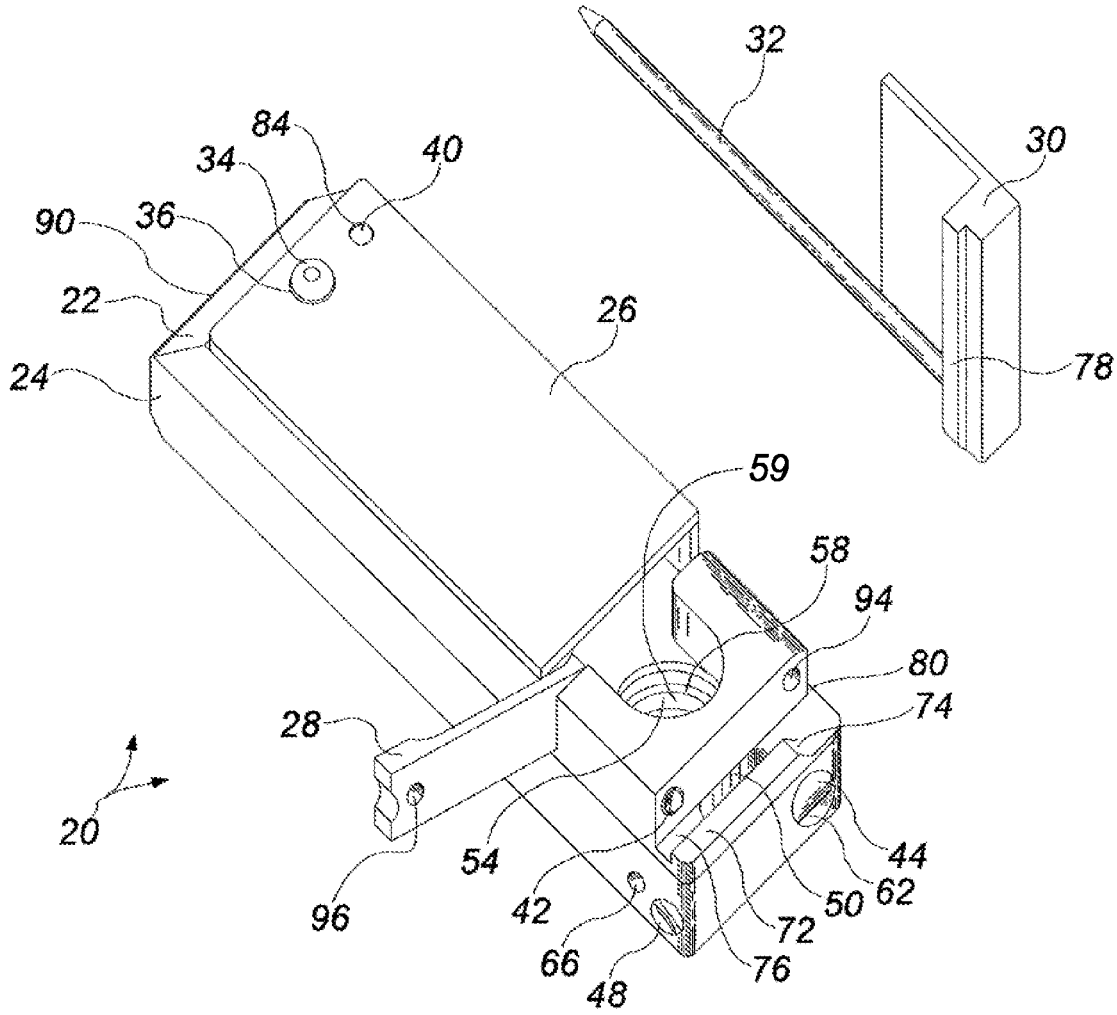
FIG. 5 is a perspective view of the smoking pipe apparatus from FIG. 4, with the bowl cover being completely removed away from the smoking pipe apparatus in addition to a gate element being pivotally opened.
Figure 6:
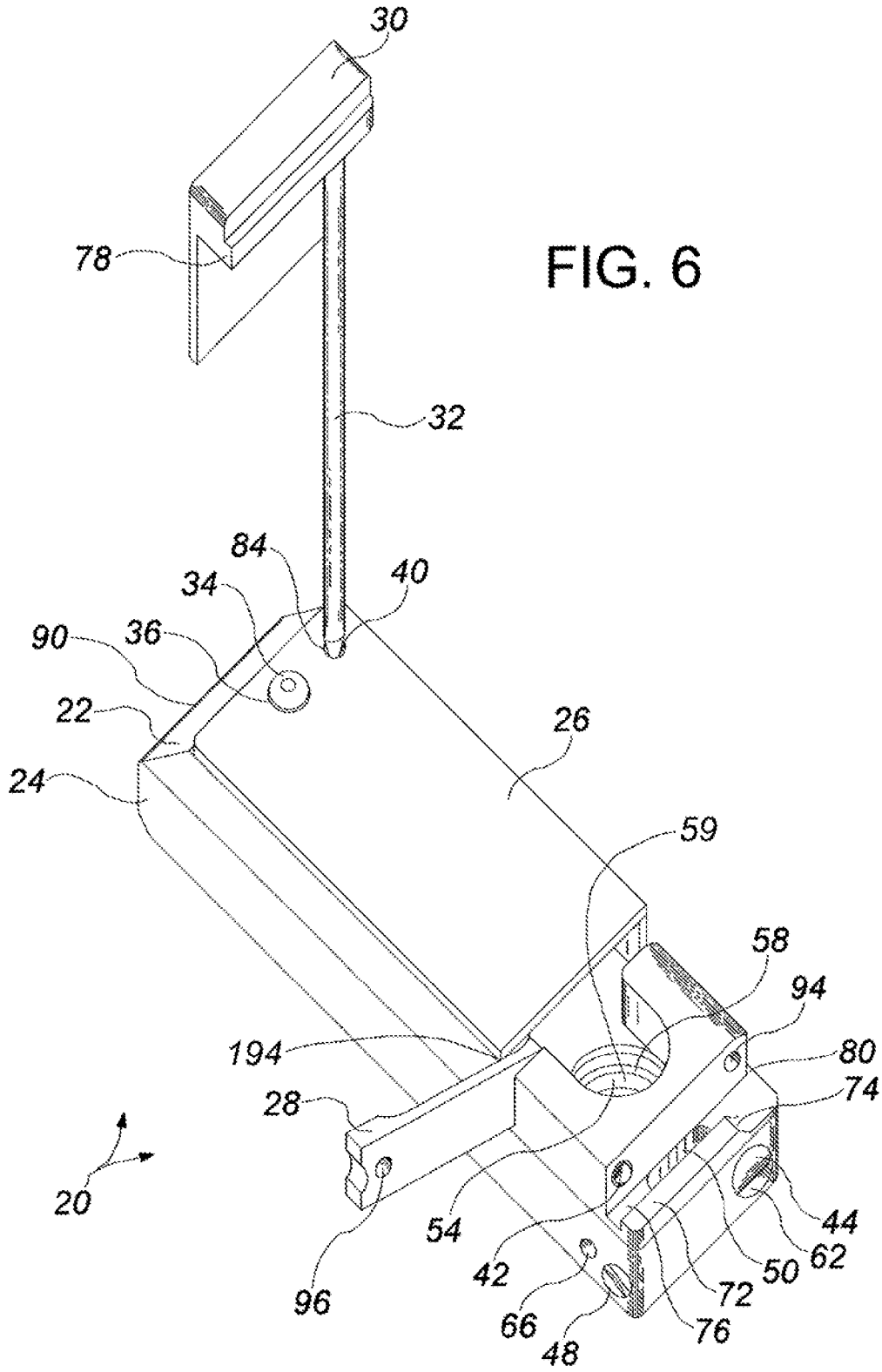
FIG. 6 is a perspective view of the smoking pipe apparatus from FIG. 5, with the bowl cover tool being used to unlock a compartment cover via being inserted into a lock plunger of the compartment cover.
Figure 7:
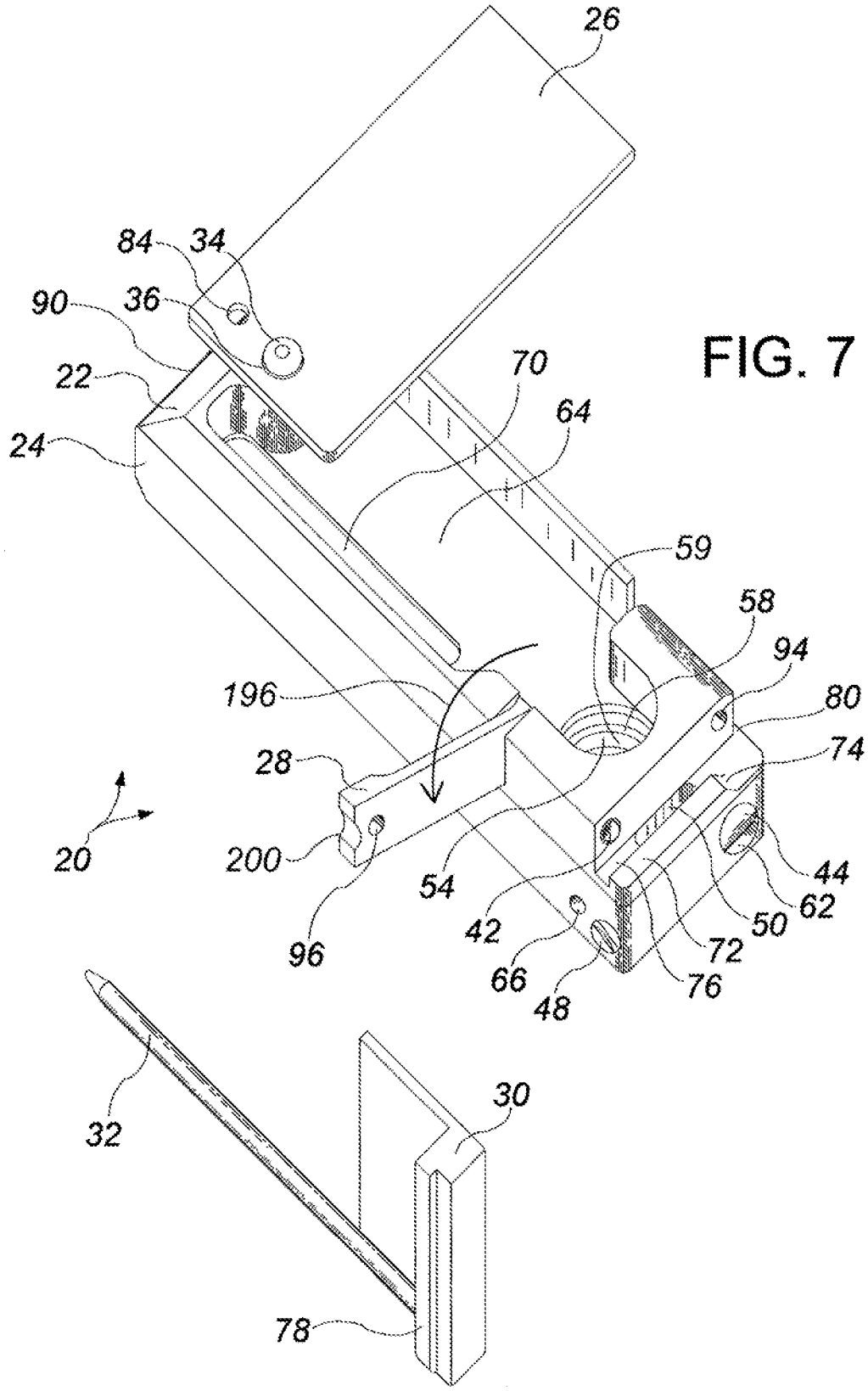
FIG. 7 is a perspective view of the smoking pipe apparatus from FIG. 6, with the compartment cover being pivotally opened to expose a main storage compartment.
Figure 8:
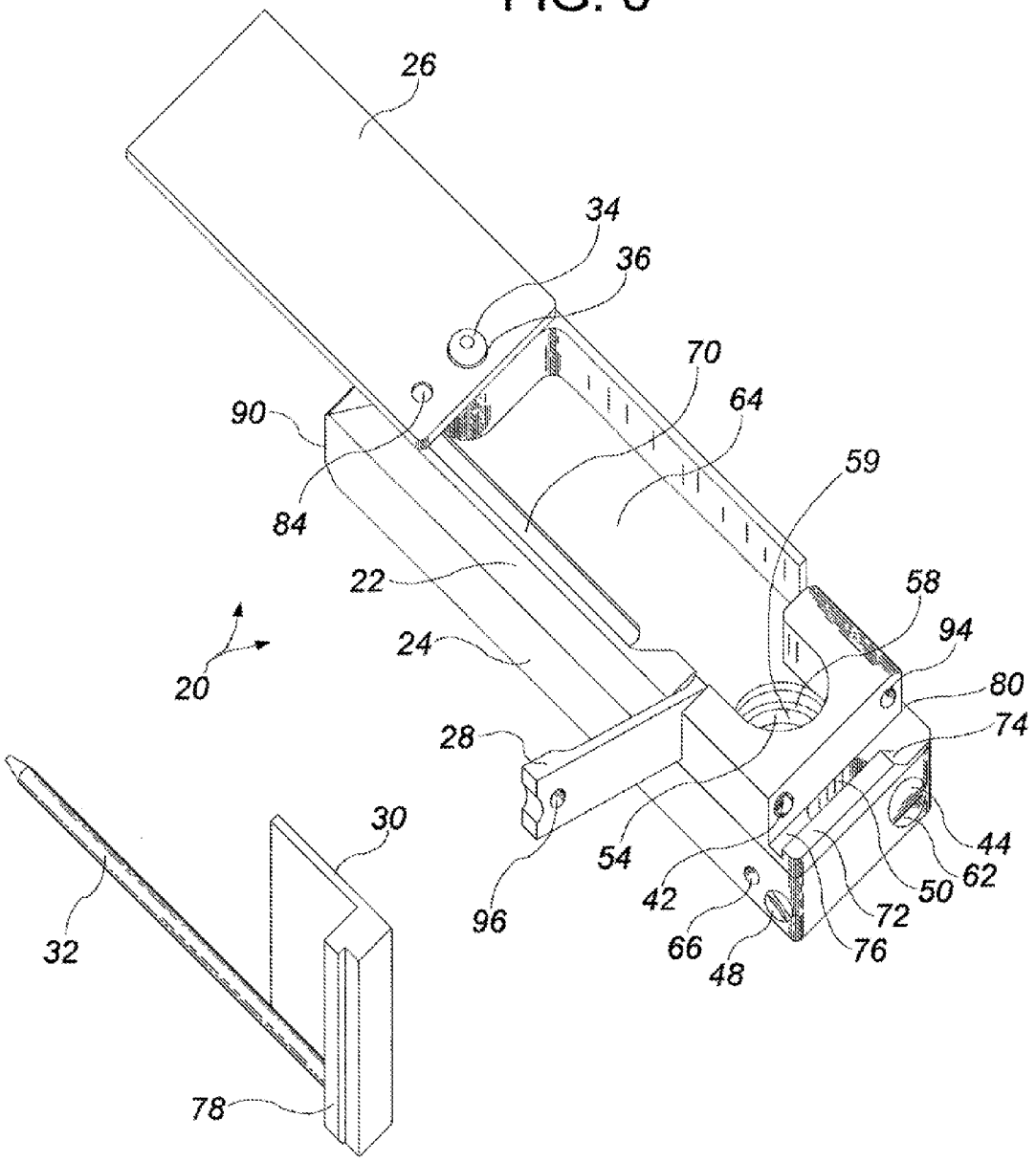
FIG. 8 is a perspective view of the smoking pipe apparatus from FIG. 7, with the compartment cover being fully pivotally opened to expose the main storage compartment.
Figure 12:
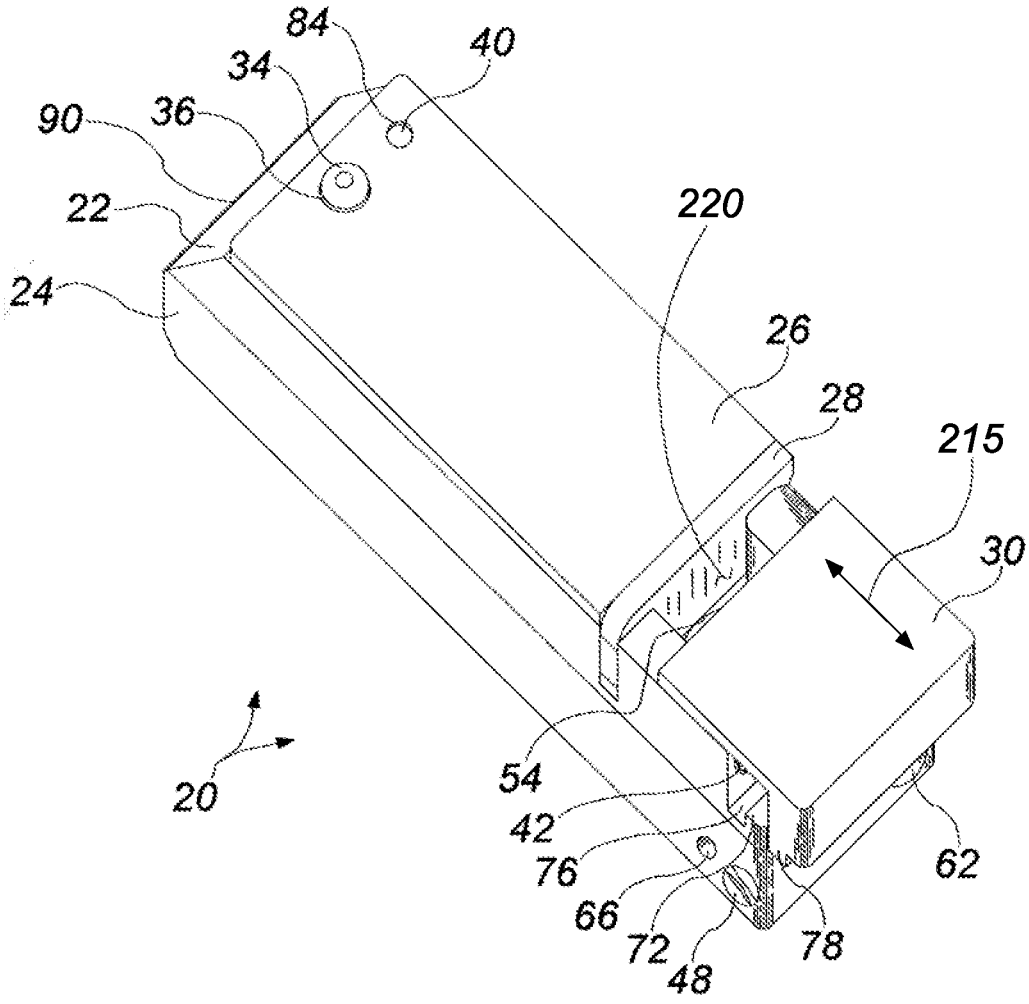
FIG. 12 is a perspective view of the smoking pipe apparatus from FIG. 11, however, with the bowl cover slid partially open along the bowl cover pivotal axis to partially expose the bowl for smoking use.
Figure 13:
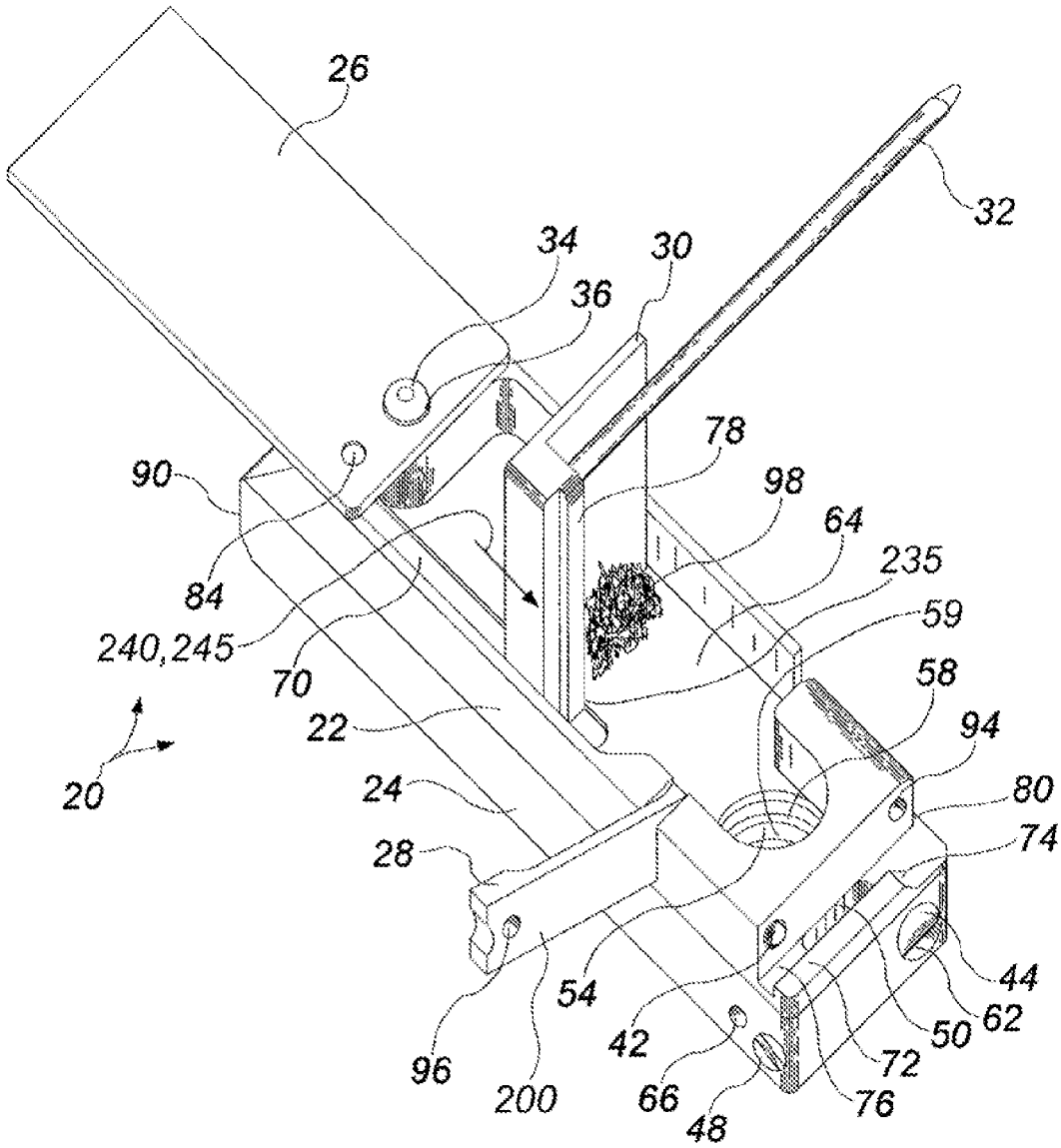
FIG. 13 is a perspective view of the smoking pipe apparatus from FIG. 8, with the compartment cover being fully pivotally opened to expose the main storage compartment, wherein the removed cover is used to move tobacco from the main storage compartment to the bowl for smoking.
Figure 26:
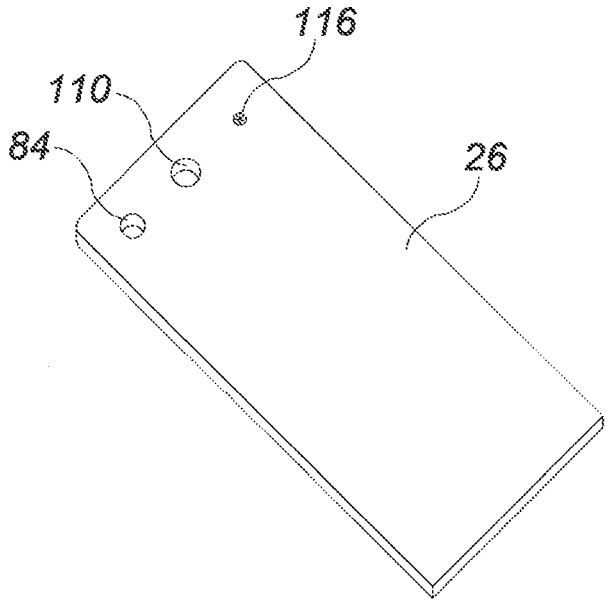
FIG. 26 is a perspective view of the compartment cover underside that is positioned adjacent to the ancillary body, with a compartment cover hinge hole, a compartment cover lock hole, and a compartment cover lock indentation.

Moving onward, FIG. 5 is a perspective view of the smoking pipe apparatus 20 from FIG. 4, with the bowl cover 30 being completely removed away from the smoking pipe apparatus 20, in addition to a gate element 28 being pivotally opened 196, see FIG. 7. Also FIG. 5 shows step 80 that is adjacent to cutout 74. Next, FIG. 6 is a perspective view of the smoking pipe apparatus 20 from FIG. 5, with the bowl cover 30 tool 32 being used to unlock a compartment cover 26 via being inserted into a compartment cover lock spring loaded detent ball 40 hole 84 of the compartment cover 26. Further, FIG. 7 is a perspective view of the smoking pipe apparatus 20 from FIG. 6, with the compartment cover 26 being pivotally opened to expose a main storage compartment 64, also shown in a storage chamber floor depression 70 which as shown in FIG. 13, has a slidable engagement sized and configured 235 with a bowl cover 30 lower ridge 78 while sliding movement 245 occurs during a slidable engagement 240 to move tobacco 98 from the main storage compartment 64 to the bowl 54. Also in FIG. 7 shown is the gate 28 pivoted 196 into the open state 200 with the gate lock hole 96 shown, wherein the gate lock hole 96 receives the tool 32 when the tool 32 is fully inserted into the tool receiving hole 94, thus locking the gate 28 into the closed state 195 as shown in FIGS. 1, 2, and 3. Continuing, FIG. 8 is a perspective view of the smoking pipe apparatus 20 from FIG. 7, with the compartment cover 26 being fully pivotally opened to expose the main storage compartment 64, note also the compartment cover 26 pivotal attachment screw 34 and washer 36, as shown in FIGS. 1 through 14, and FIGS. 16 through 21. The compartment cover lock indentation 116, see FIG. 26, is operational to provide a tactile rotational stop to the compartment cover 26 in going from the position in FIG. 6, further progressing to FIG. 7, and then having the tactile stop in FIG. 8, respectively for the compartment cover 26 in going from the closed to the open position over the main storage compartment 64 to keep the compartment cover lock spring loaded detent ball 40 adjacent to the compartment cover 26.

Figure 9:
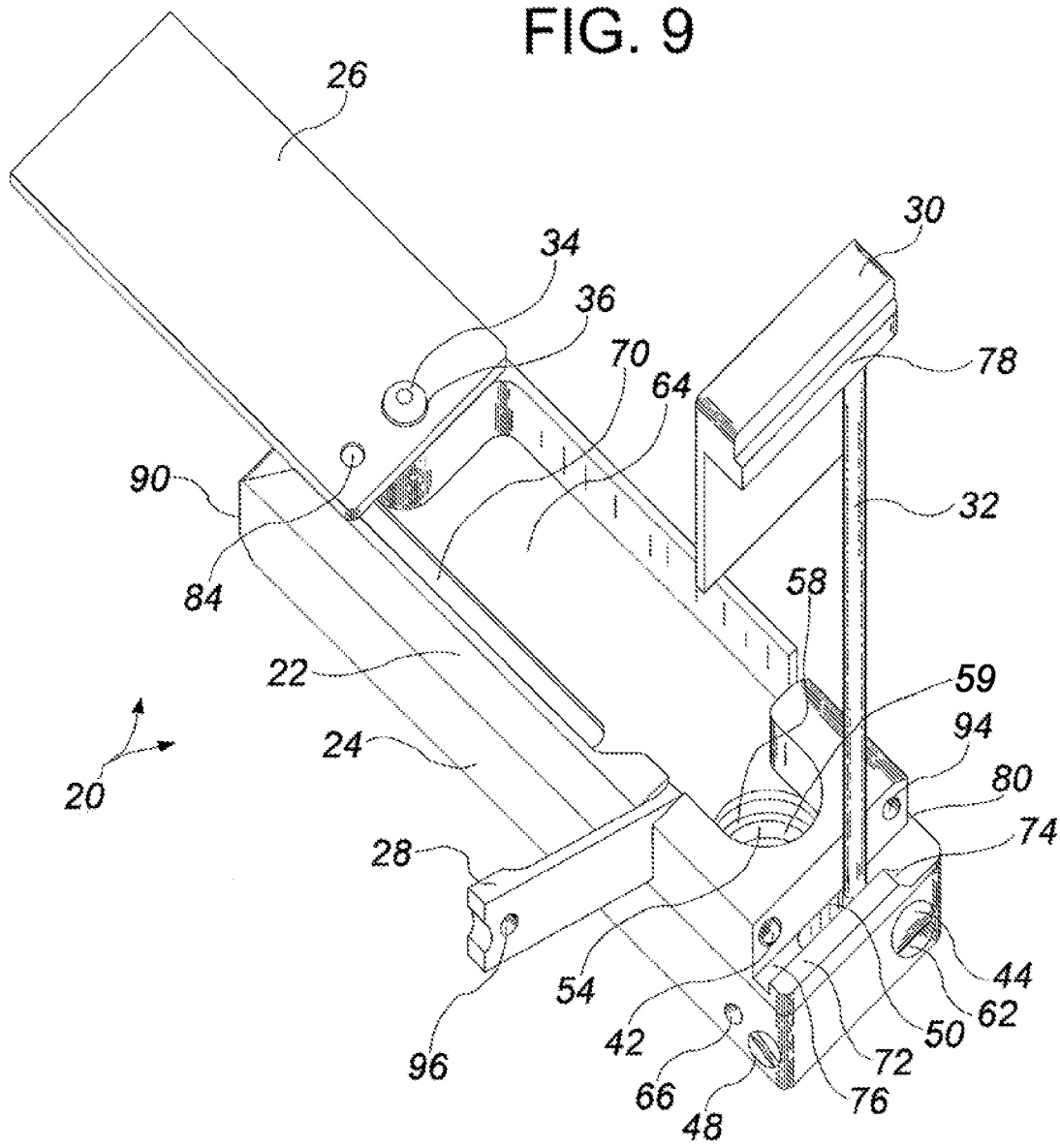
FIG. 9 is a perspective view of the smoking pipe apparatus from FIG. 8, with the bowl cover tool being inserted into an elongated aperture wherein the tool contacts a plunger.
Figure 10:
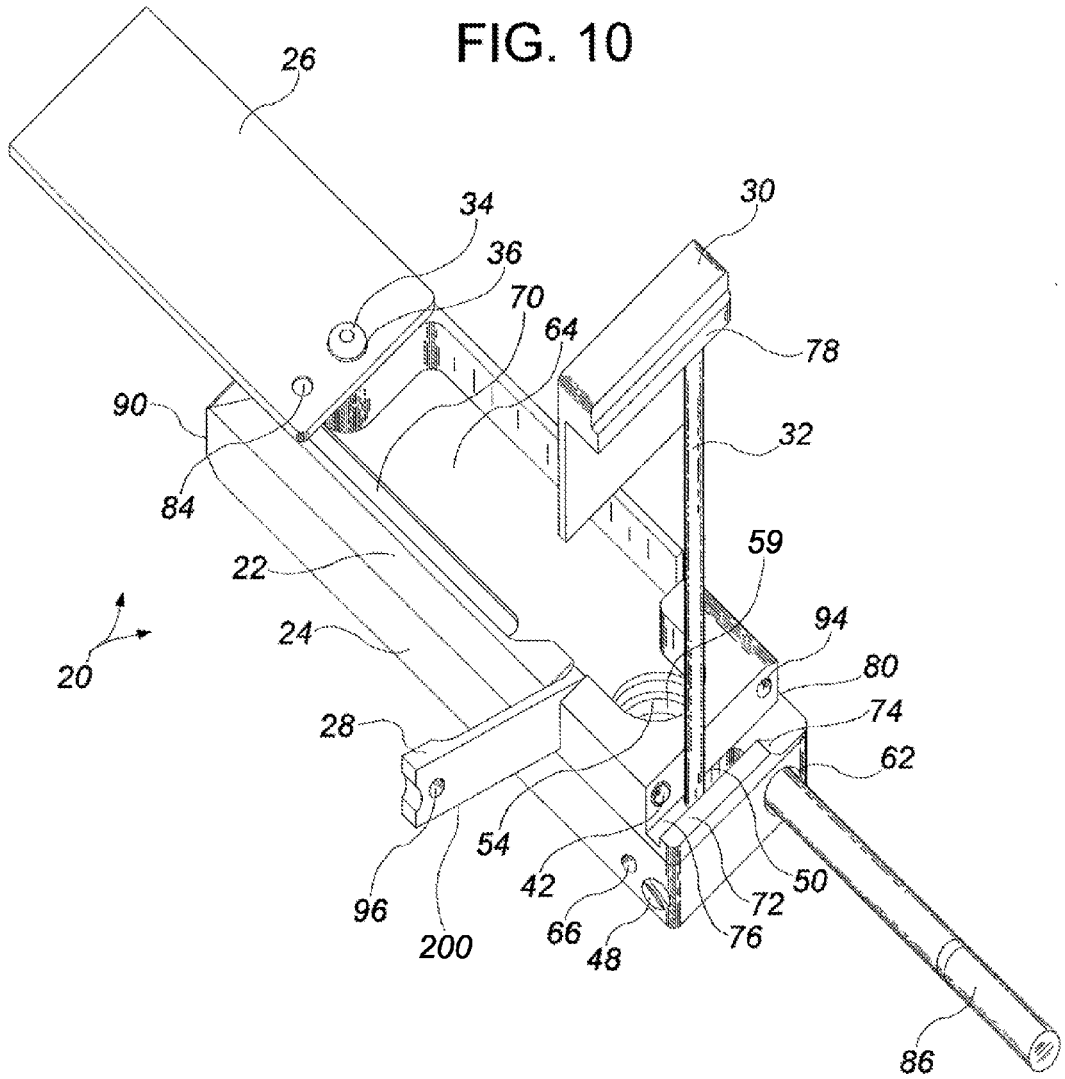
FIG. 10 is a perspective view of the smoking pipe apparatus from FIG. 9, with the bowl cover tool being moved within the elongated aperture to slide the plunger thereby opening a secondary storage compartment that shows a cigarette being removed therefrom.
Figure 11:
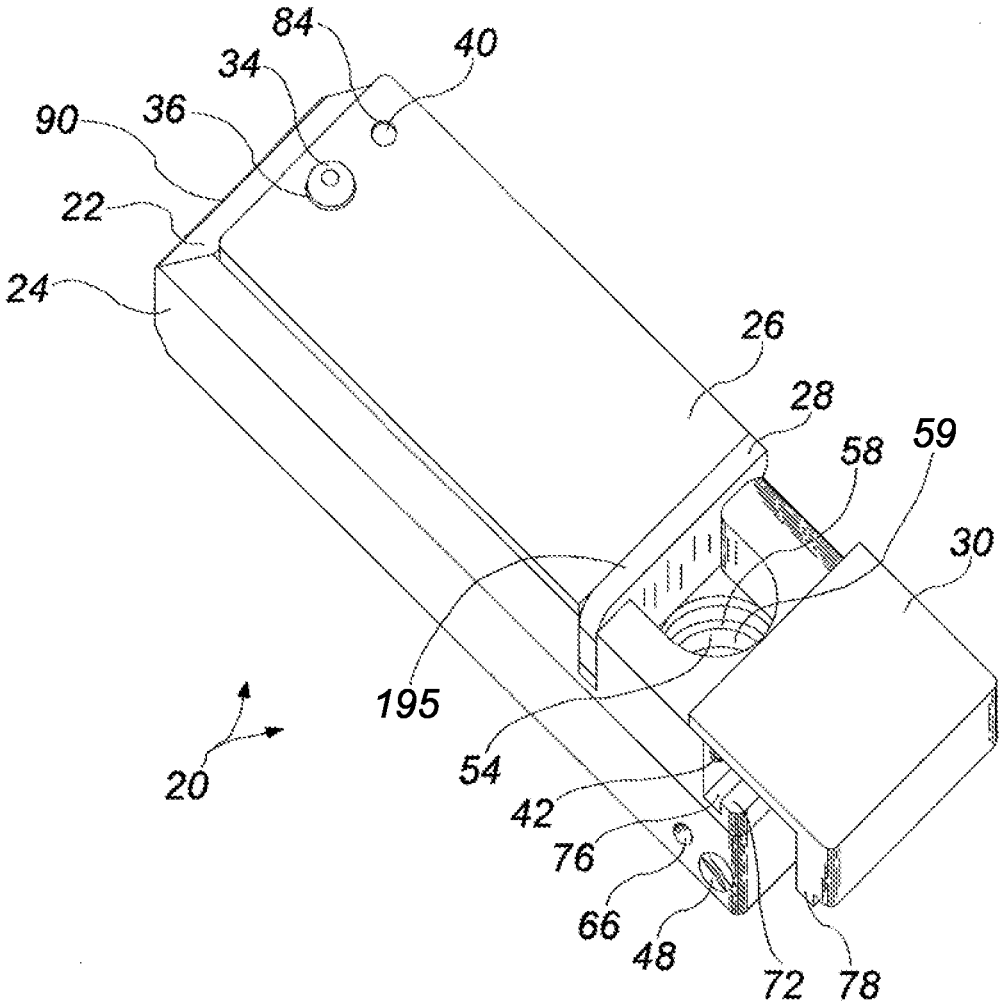
FIG. 11 is a perspective view of the smoking pipe apparatus from FIG. 1, however, with the bowl cover slid open along the bowl cover pivotal axis to expose the bowl for smoking use.

Next, FIG. 9 is a perspective view of the smoking pipe apparatus 20 from FIG. 8, with the bowl cover 30 tool 32 being inserted into an elongated aperture 50 wherein the tool 32 contacts a plunger 44. Moving onward, FIG. 10 is a perspective view of the smoking pipe apparatus 20 from FIG. 9, with the bowl cover 30 tool 32 being moved within the elongated aperture 50 to slide the plunger 44 thereby opening access to a secondary storage compartment 62 that shows a cigarette 86 being removed therefrom. Further, FIG. 11 is a perspective view of the smoking pipe apparatus 20 from FIG. 1, however, with the bowl cover 30 slid open along the bowl cover pivotal axis 210 (not shown) to expose the bowl 54 for smoking use. Next, FIG. 12 is a perspective view of the smoking pipe apparatus 20 from FIG. 11, however, with the bowl cover 30 slid 215 partially open along the bowl cover 30 pivotal axis 210 (not shown) to partially expose the bowl 54 for smoking use via controlling an area opening 220 between the bowl 54 and the exterior environment 160.

Figure 14:
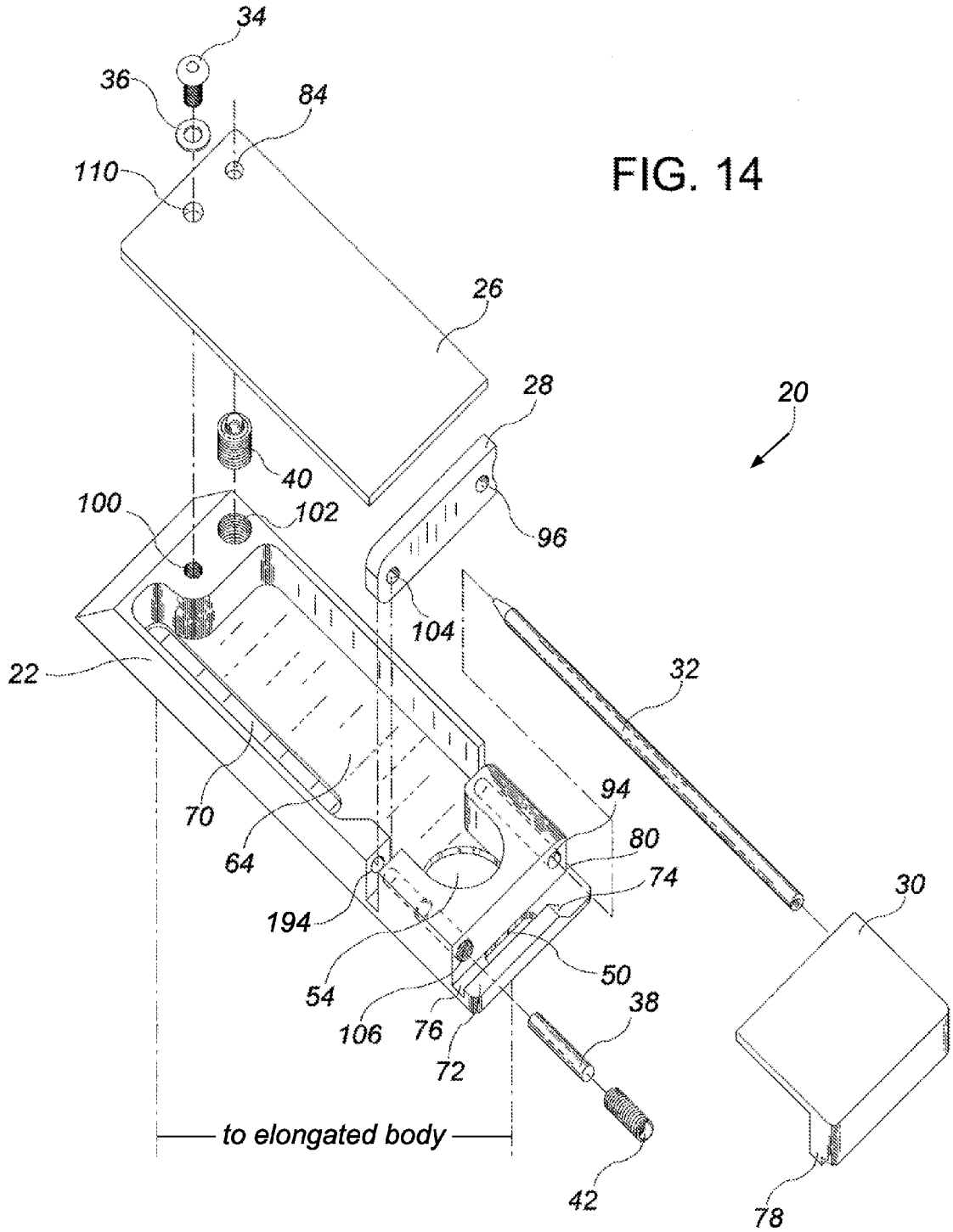
FIG. 14 is an exploded perspective view of an elongated ancillary body of the smoking pipe apparatus showing the main storage compartment, the compartment cover, the gate, and its pivotal attachment to the elongated ancillary body, also shown is the bowl cover and its tool with the tool receiving hole.

Continuing, FIG. 13 is a perspective view of the smoking pipe apparatus 20 from FIG. 8, with the compartment cover 26 being fully pivotally opened to expose the main storage compartment 64, wherein the removed cover 30 is used to move tobacco 98 from the main storage compartment 64 to the bowl 54 for smoking. Next, FIG. 14 is an exploded perspective view of an elongated ancillary body 22 of the smoking pipe apparatus 20 showing the main storage compartment 64, the compartment cover 26, the gate 28, and the gate 28 pivotal attachment 194 to the elongated ancillary body 22, also shown is the bowl cover 30 and the bowl cover 30 tool 32 with the tool 32 receiving hole 94. Also, FIG. 14 shows the gate 28 hinge hole 104 that pivotally interfaces with a gate hinge pin 38 allowing pivotal movement 196 as shown in FIG. 7. In addition, FIG. 14 shows the compartment cover 26 hinge hole 100 to accommodate screw 34 and washer 36 for pivoting movement of the compartment cover 26 to close and open the main storage compartment 64, and to lock the compartment cover 26 closed over the main storage compartment 64, a lock plunger cavity 102 interfaces with a cover lock hole 84, as shown in FIGS. 1 through 5. Further, FIG. 15 shows a perspective view on an elongated body 24 showing the bowl 54, with a bowl surrounding sidewall 54, a bowl center ridge 56, a plurality of air passageways 60, the elongated aperture 50, with the plunger 44 removed from the elongated body 24 for clarity, showing a plunger recess 52 that received the bowl cover 30 tool 32, also shown is the secondary storage compartment 62, a screen storage area 68, and a pipe cleaner storage slot 88.

Figure 15:
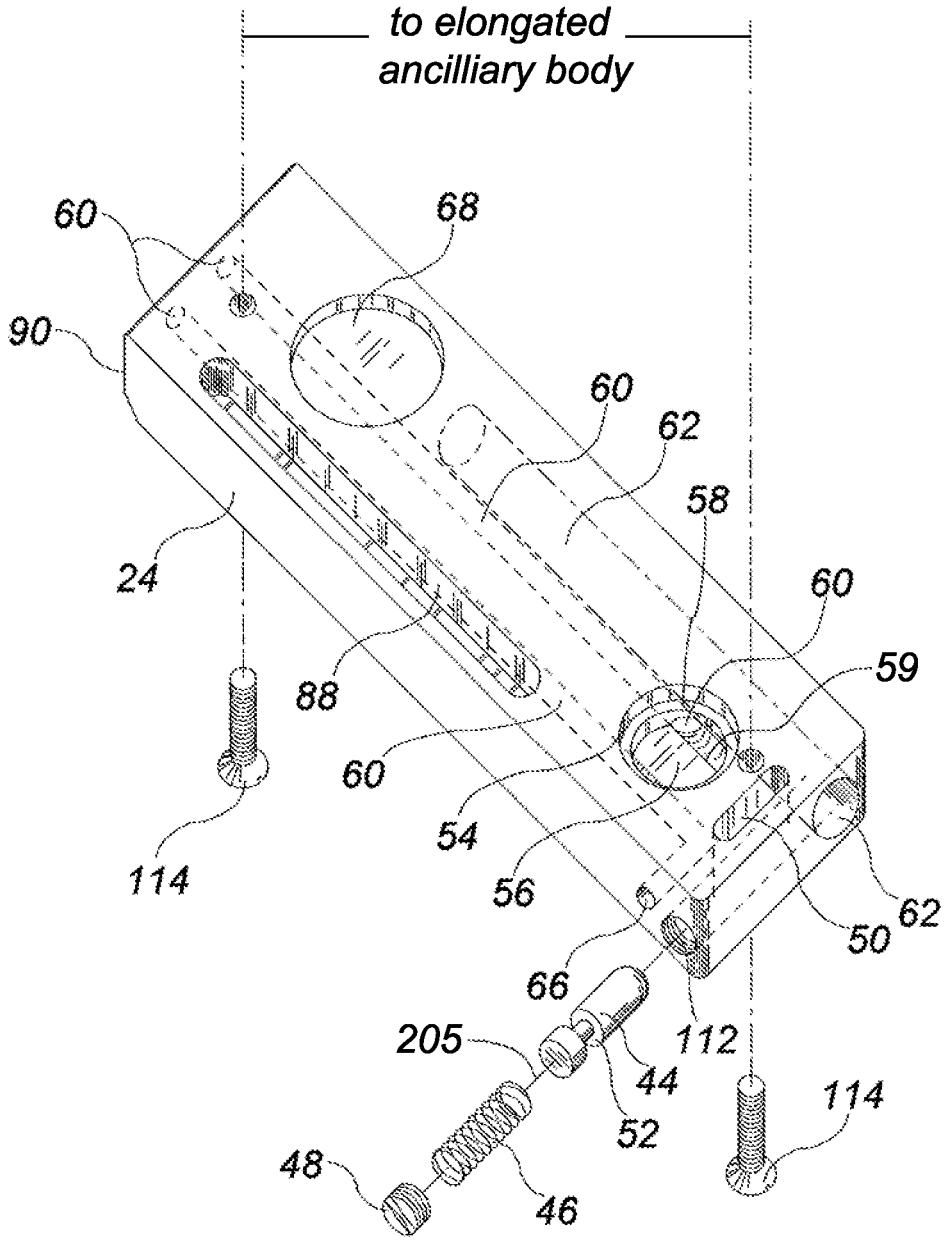
FIG. 15 shows a perspective view on an elongated body showing the bowl, with a bowl surrounding sidewall, a bowl center ridge, a plurality of air passageways, the elongated aperture, with the plunger removed for clarity showing a plunger recess that received the bowl cover tool, also shown is the secondary storage compartment, a screen storage area, and a pipe cleaner storage slot.
Figure 16:
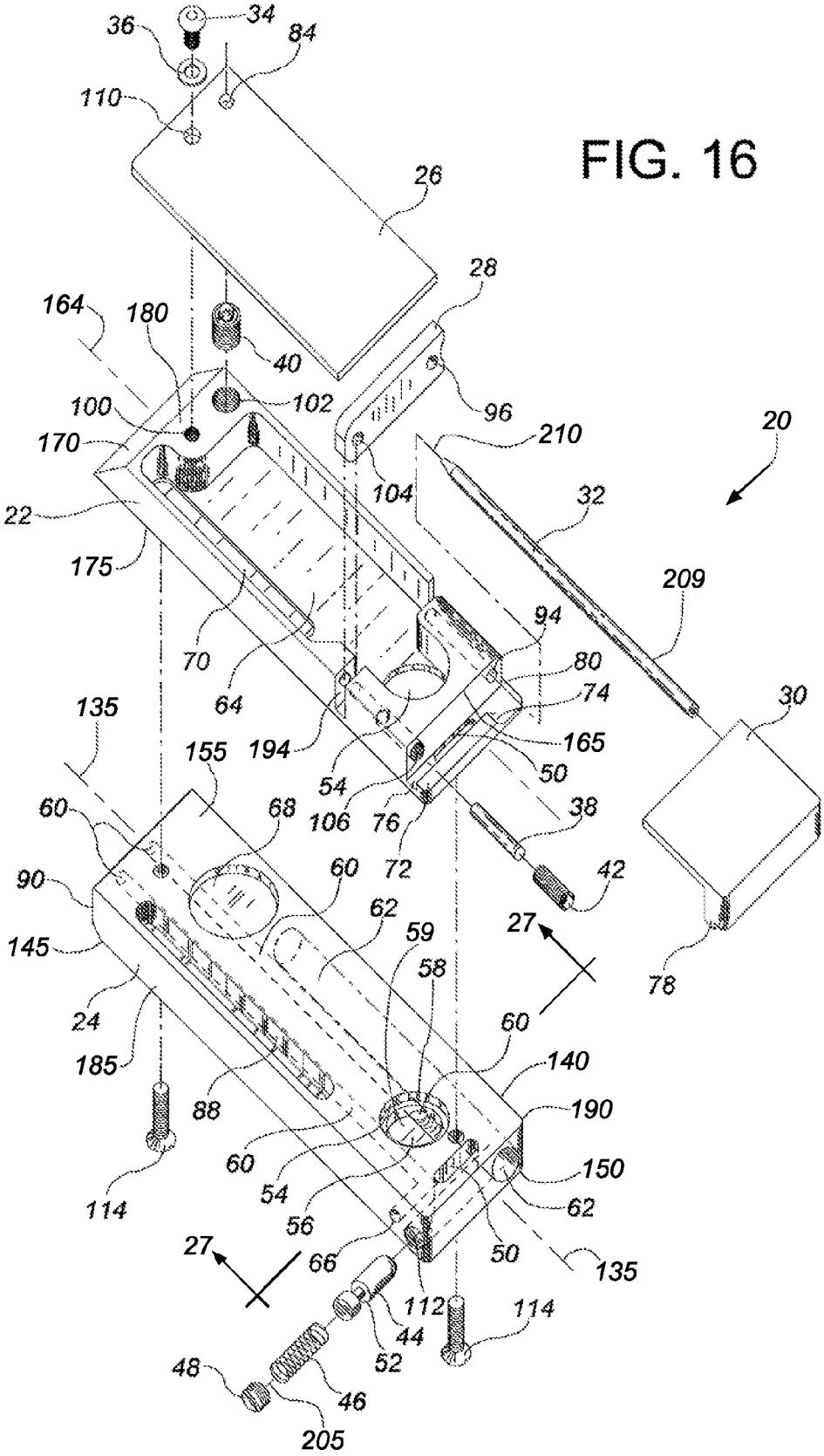
FIG. 16 shows an exploded perspective view of FIGS. 14 and 15 in relation to one another showing in particular the mating interface of the elongated body and the elongated ancillary body that form the smoking pipe apparatus, noting in particular cross section cut 27-27 that details the bowl, screen, bowl vent chamber void, and air passageways structural detail in FIG. 27.
Figure 17:
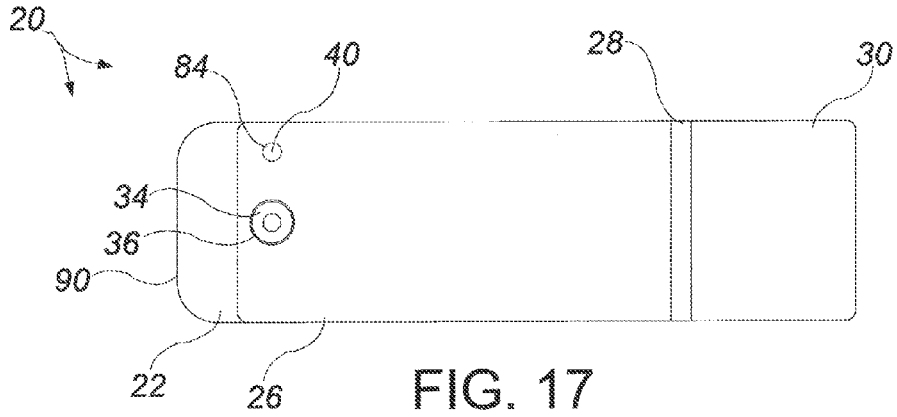
FIG. 17 shows a top or free portion side external plan view of the smoking pipe apparatus, showing the compartment cover, the elongated ancillary body, the gate, and the bowl cover.
Figure 18:
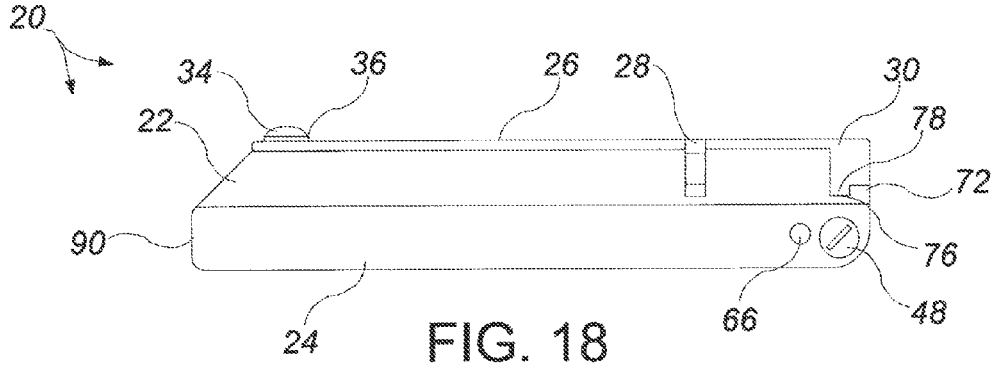
FIG. 18 shows a side elevation view of the smoking pipe apparatus, showing the compartment cover, the elongated ancillary body, the gate, the bowl cover, the elongated body, the vent, and the plug.
Figure 27:
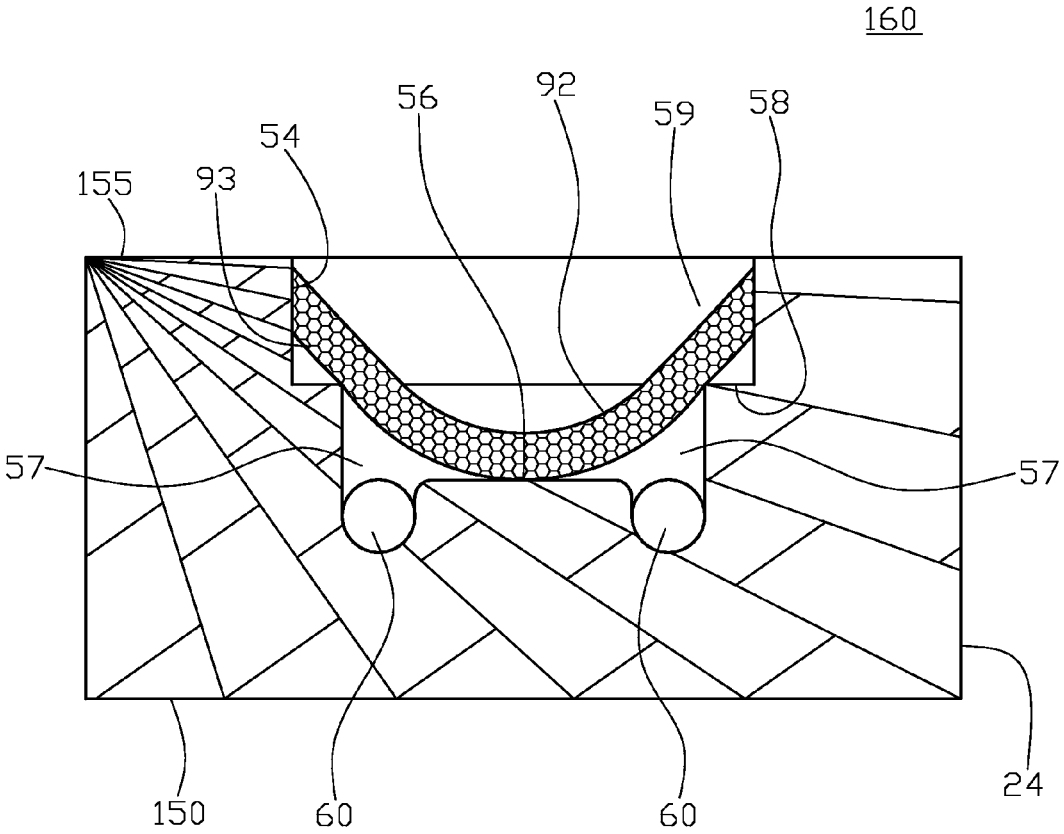
FIG. 27 is cross section cut 27-27 from FIG. 16 showing detail from the bowl area including the bowl surrounding sidewall, the bowl side step, the bowl interior, the screen outer periphery resting upon the bowl side step and the bowl center ridge forming a concave shape of the screen, also shown is the bowl vent chamber void, and the passageways all disposed within the elongated body.

Yet further, FIG. 16 shows an exploded perspective view of FIGS. 14 and 15 in relation to one another showing in particular the mating interface 155 of the elongated body 24 to the mating portion side 175 of the elongated ancillary body 22 that form the smoking pipe apparatus 20 assembly, wherein the interface of the elongated body 24 and the elongated ancillary body 22 is preferably accomplished via screws 114, noting in particular cross section cut 27-27 that details the bowl 54, screen 92, bowl vent chamber void 57, and air passageways 60 structural detail in FIG. 27. Next, in FIG. 17 shown is a top or free portion side 180 external plan view of the smoking pipe apparatus 20, showing the compartment cover 26, the elongated ancillary body 22, the gate 28, and the bowl cover 30. Continuing, FIG. 18 shows a side elevation view of the smoking pipe apparatus 20, showing the compartment cover 26, the elongated ancillary body 22, the gate 28, the bowl cover 30, the elongated body 24, the vent 66, and the plug 48.

Figure 19:
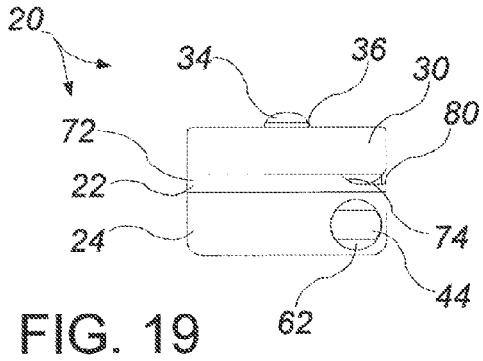
FIG. 19 shows a frontal or distal end portion of the smoking pipe apparatus showing the elongated body, the elongated ancillary body, the bowl cover, and the plunger blocking the entrance to the secondary storage compartment.
Figure 20:
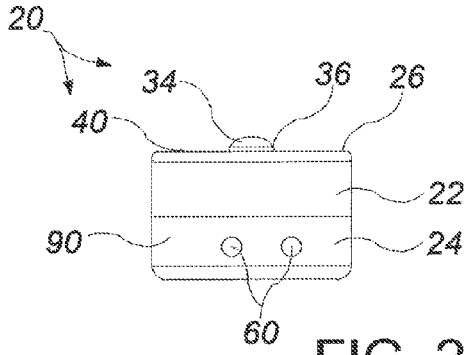
FIG. 20 shows a rear or proximal end portion of the smoking pipe apparatus showing the elongated body, the elongated ancillary body, the compartment cover, and the air passageways disposed within the elongated body.
Figure 21:
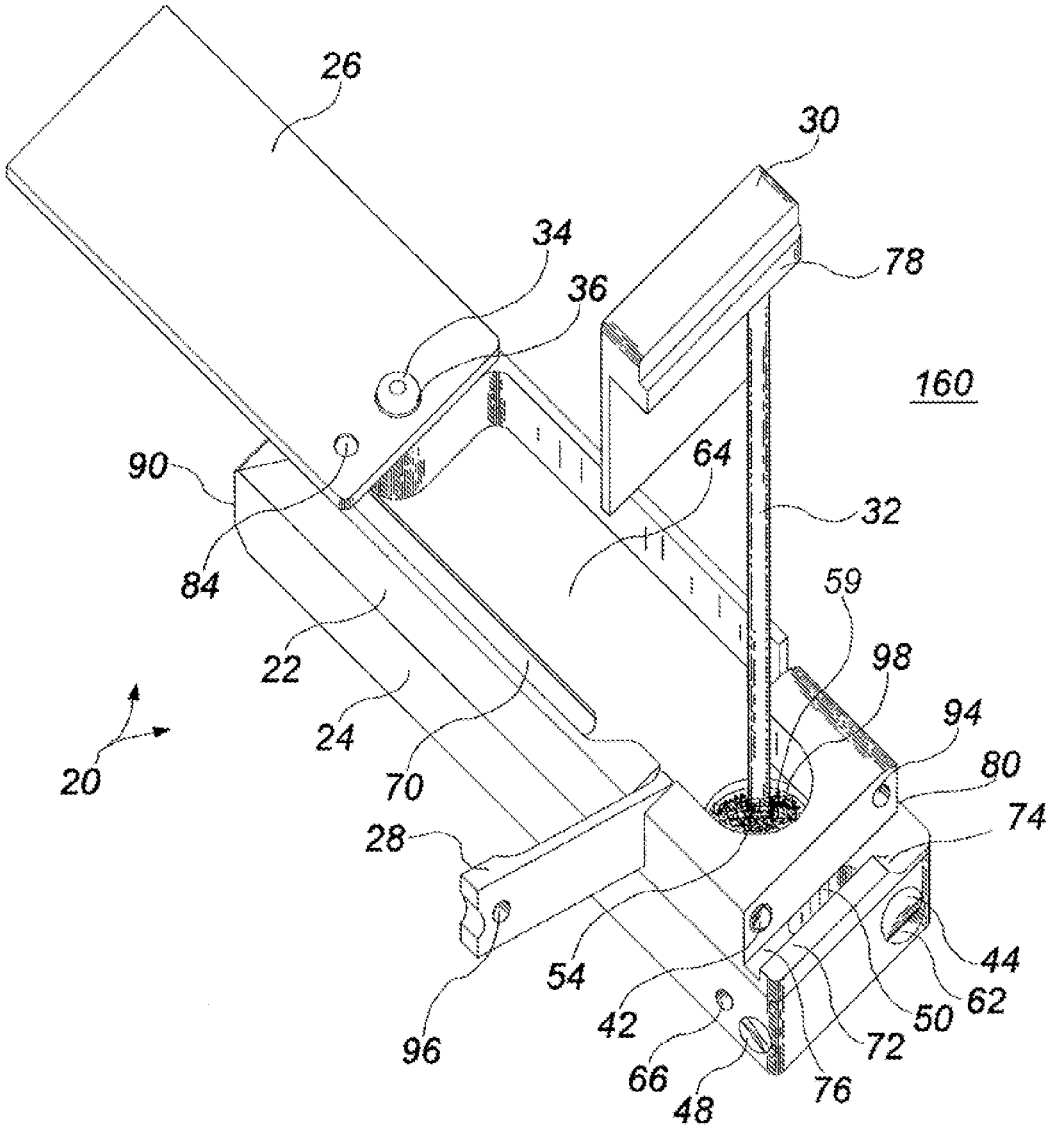
FIG. 21 is a perspective view of the smoking pipe apparatus from FIG. 8, with the compartment cover being fully pivotally opened to expose the main storage compartment, wherein the bowl cover tool is used to stir or manipulate tobacco disposed within the bowl interior.

Next, FIG. 19 shows a frontal or distal end portion 165 of the smoking pipe apparatus 20 showing the elongated body 24, the elongated ancillary body 22, the bowl cover 30, and the plunger 44 blocking the entrance to the secondary storage compartment 62. Further, FIG. 20 shows a rear or proximal end portion 170 of the smoking pipe apparatus 20 showing the elongated body 24, the elongated ancillary body 22, the compartment cover 26, and the air passageways 60 disposed within the elongated body 24, further the mouthpiece 90 is shown adjacent to the air passageways 60 for creating a manual vacuum in the passageways 60. Moving onward, FIG. 21 is a perspective view of the smoking pipe apparatus 20 from FIG. 8, with the compartment cover 26 being fully pivotally opened to expose the main storage compartment 64, wherein the bowl cover 30 tool 32 is used to stir or manipulate tobacco 98 disposed within the bowl 54 interior 59.

Figure 22:
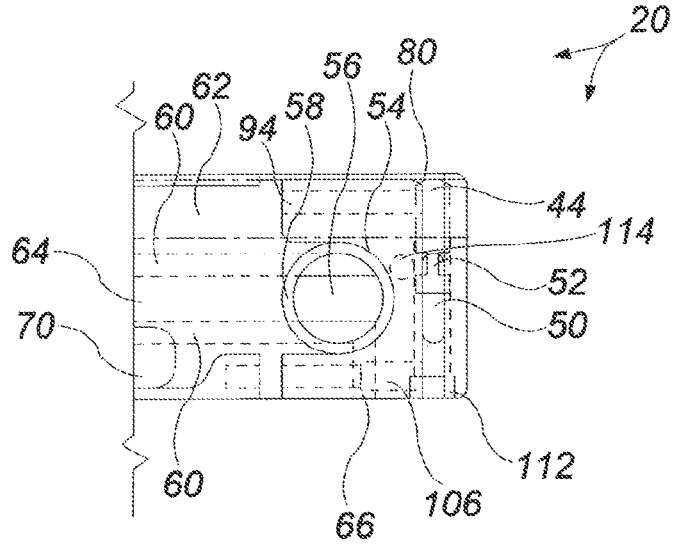
FIG. 22 shows a top or free portion side external plan view of the smoking pipe apparatus, showing in particular the bowl area with the bowl center ridge, the air passageways, the plunger, the plunger recess, the elongated aperture, the main storage compartment, and the secondary storage compartment.
Figure 23:
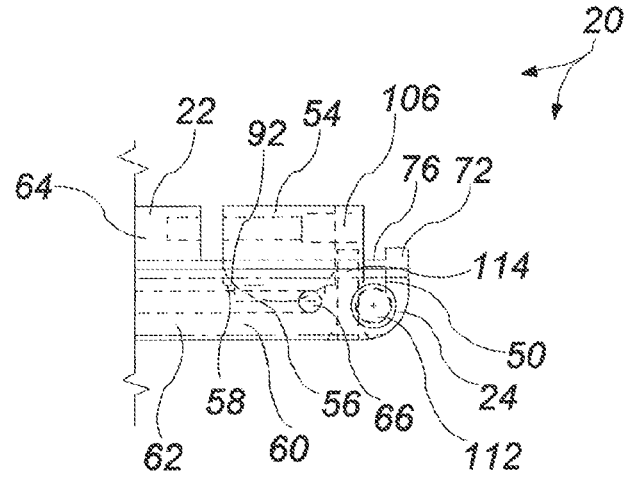
FIG. 23 shows a side elevation view of the smoking pipe apparatus, showing in particular the frontal or distal end portion with the elongated body, the elongated ancillary body, bowl, the bowl center ridge, the screen concavity, the air passageways, the elongated aperture, the vent, and a cavity for the plunger.
Figure 24:
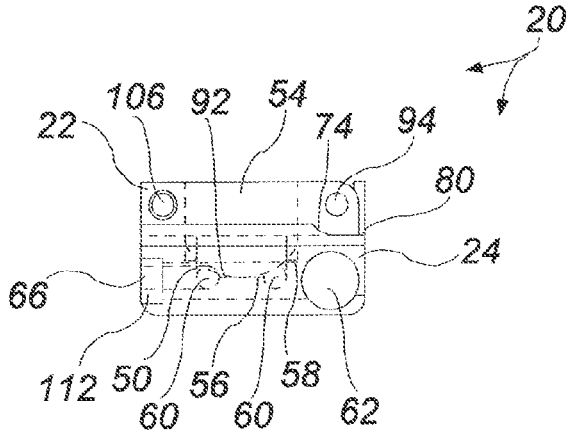
FIG. 24 shows a frontal or distal end portion of the smoking pipe apparatus showing the elongated body, the elongated ancillary body, with the bowl cover removed showing the tool receiving hole and the bowl cover lock, the secondary storage compartment, the plunger cavity, the vent, and further the bowl surrounding sidewall, the screen, the bowl center ridge, a bowl side step, and the air passageways.

Further, FIG. 22 shows a top or free portion side 180 external plan view of the smoking pipe apparatus 20, showing in particular the bowl 54 area with the bowl center ridge 56, the air passageways 60, the plunger 44, the plunger recess 52, the elongated aperture 50, the main storage compartment 64, and the secondary storage compartment 62. Continuing, FIG. 23 shows a side elevation view of the smoking pipe apparatus 20, showing in particular the frontal or distal end portion 165 with the elongated body 24, the elongated ancillary body 22, bowl 54, the bowl center ridge 56, the screen 92 concavity, the air passageways 60, the elongated aperture 50, the vent 66, and a cavity 112 for the plunger 44. Next, FIG. 24 shows a frontal or distal end portion 165 of the smoking pipe apparatus 20 showing the elongated body 24, the elongated ancillary body 22, with the bowl cover 30 removed showing the tool receiving hole 94 and the bowl cover 30 lock 106, the secondary storage compartment 62, the plunger 44 cavity 112, the vent 66, and further the bowl surrounding sidewall 54, the screen 92, the bowl center ridge 56, a bowl side step 58, and the air passageways 60.

Figure 25:
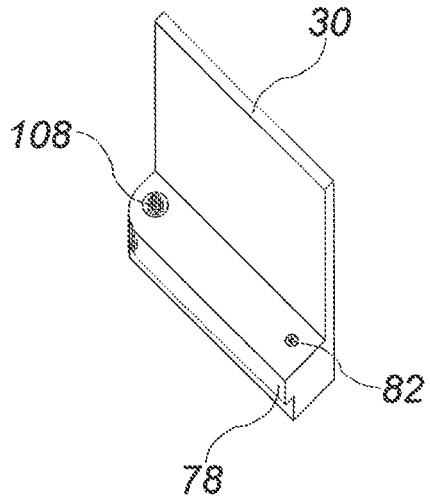
FIG. 25 is a perspective view of the bowl cover showing the tool receiving cavity, a bowl cover lower ridge, and a bowl cover lock indentation.

Next, FIG. 25 is a perspective view of the bowl cover 30 showing the tool 32 receiving cavity 108, a bowl cover 30 lower ridge 78, and a bowl cover 30 lock indentation 82, note that bowl cover lock indentation 82 interfaces with a bowl cover 30 lock spring loaded detent ball 42, as shown in FIGS. 2 through 10, when the bowl cover 30 is in the closed state 225, as shown in FIG. 1, and FIGS. 17 through 20. Continuing, FIG. 26 is a perspective view of the compartment cover 26 underside that is positioned adjacent to the ancillary body, with a compartment cover hinge hole 110, a compartment cover lock hole 84, and a compartment cover lock indentation 116. Further, FIG. 27 is cross section cut 27-27 from FIG. 16 showing detail from the bowl area including the bowl surrounding sidewall 54, the bowl side step 58, the bowl interior 59, the screen 92 outer periphery 93 resting upon the bowl side step 58, and the bowl center ridge 56 forming a concave shape of the screen 92 on the tobacco 98 side, see FIG. 28, wherein returning to FIG. 27 also shown is the bowl vent chamber void 57, and the passageways 60 all disposed within the elongated body 24. Further, FIG. 28 shows FIG. 27 in use with tobacco 98 placed within the concavity of the screen 92, and using a lighter 125 flame 120 to ignite the tobacco 98, wherein the smoke diffuses 130 throughout the bowl vent chamber void 57 that forms an annulus about a convex portion of the screen 92 for omni directionally even tobacco 98 burning throughout the concave portion of the screen 92, wherein the smoke diffusion 130 eventually goes into the passageways 60 from the manual drawing of the smoke from the user smoker who manually creates a vacuum in the passageways 60.

With reference to FIGS. 1-24, broadly disclosed the smoking pipe apparatus 20 for smoking tobacco 98, that includes an elongated body 24 having a longitudinal axis 135, with the elongated body 24 including a first end portion 140 and an opposing second end portion 145, the elongated body 24 also including a base portion side 150 and an opposing primary portion side 155, further the elongated body 24 includes a first margin 185 and an opposing second margin 190, as best shown in FIG. 16. Also included in the smoking pipe apparatus 20 is the bowl 54 disposed partially within the first end portion 140 from the primary portion side 155, the bowl including a surrounding sidewall 54 that extends from the step 58 and terminates at the primary portion side 155, wherein the sidewall 54 defines a bowl interior 59 separated from an exterior environment 160, the bowl also includes a plurality of chamber voids 57 that are disposed inward from the step 58 toward the base side portion 150, as best shown in FIGS. 27 and 28. Wherein the plurality of chamber voids 57 inwardly terminate at a centrally disposed ridge 56 that is positioned inward from the step 58 toward the base side portion 150, wherein the ridge 56 is extended toward the primary side portion 155, being positioned between the step 58 and the chamber voids 57, again as best shown in FIGS. 27 and 28.

Figure 28:
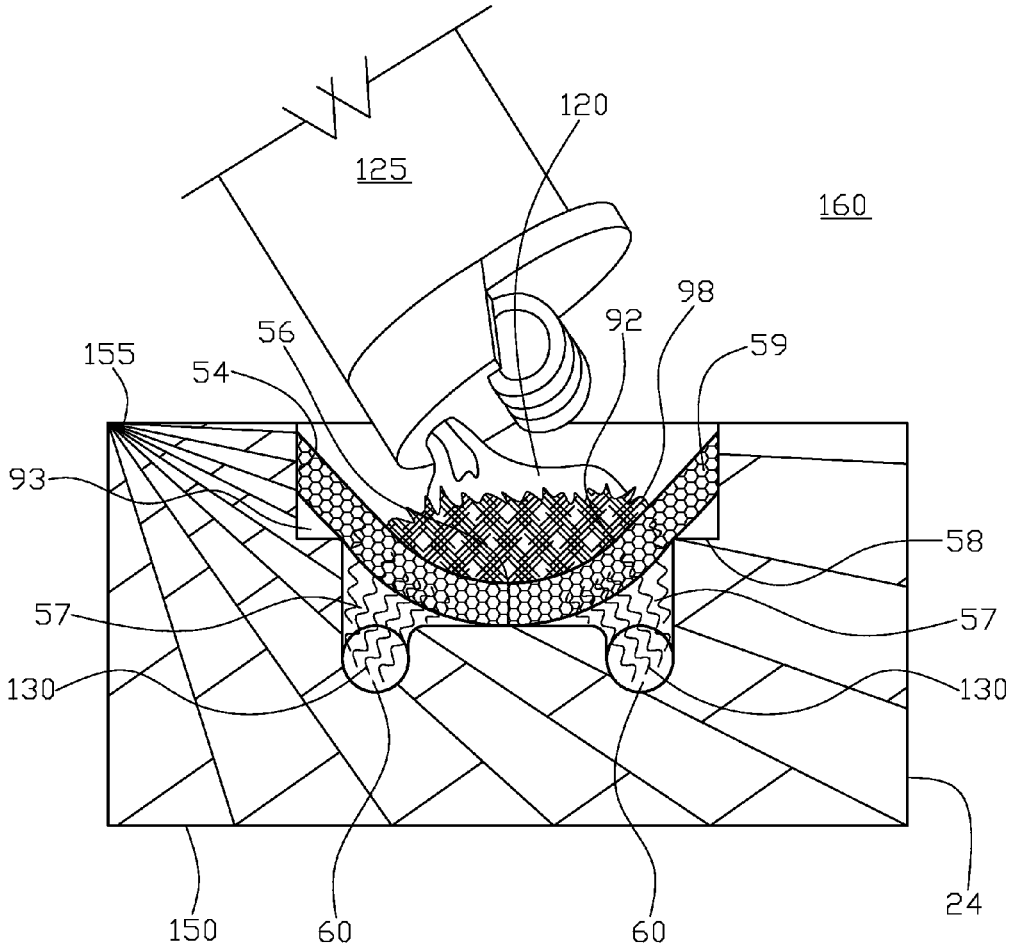
FIG. 28 shows FIG. 27 in use with tobacco placed within the concavity of the screen, and using a lighter to ignite the tobacco wherein the smoke diffuses throughout the bowl vent chamber void that forms an annulus about a convex portion of the screen for omni directionally even tobacco burning throughout the concave portion of the screen, wherein the smoke diffusion eventually goes into the passageways.

Further included in the smoking pipe apparatus 20, are the plurality of passageways 60 extending from the second end portion 145 to the plurality of chamber voids 57, wherein the plurality of passageways 60 are disposed within the elongated body 24, each of the passageways 60 is in fluid communication with each of the chamber voids 57, see FIGS. 15, 16, 27, and 28. Also included in the smoking pipe apparatus 20 is the screen 92 that is disposed within the sidewall 54, wherein the screen 92 is supported on an outer periphery 93 by the step 58 and the screen 92 is centrally supported by the ridge 56, wherein the screen 92 assumes a concave shape as viewed from the primary side portion 155, again see FIGS. 15, 16, 27, and 28. Wherein operationally when tobacco 98 is placed within the screen 92 concave shape and with an activation of the lighter 125 from the primary side portion 155 adjacent to the tobacco 92 and simultaneously with a manual creation of a vacuum at the plurality of passageways 60 on the second end portion 145, a diffusion of tobacco smoke 130 is created with the plurality of chamber voids 57 to result in a more centrally outward omnidirectional burn of the tobacco 92 therethrough said screen 92 as shown in FIG. 28.

Alternatively, the smoking pipe apparatus 20 can further comprise an elongated ancillary body 22 having a long axis 164, the elongated ancillary body 22 having a distal end portion 165 and an opposing proximal end portion 170, the elongated ancillary body 22 also including a mating portion side 175 and an opposing free portion side 180, see FIGS. 14 and 16 in particular. Wherein the primary side portion 155 and the mating portion side 175 are removably engaged to one another, see FIGS. 16, 18, 19, and 20, being positioned such that the longitudinal axis 135 and the 164 long axis are parallel to one another, see FIG. 16, the elongated ancillary body 22 further comprising a main storage compartment 64 for tobacco 98, as best shown in FIGS. 13, 16, and 21.

Further, on the smoking pipe apparatus 20 on the elongated ancillary body 22 further comprises a cover 30 for the bowl 54, wherein the cover is pivotally attached 209 via a pivotal attachment 209 to the distal end portion 165 having a pivotal axis 210, wherein the pivotal axis 210 is parallel to the longitudinal axis 135 and the long axis 164, see FIGS. 1 through 5. Wherein the cover 30 has a closed operational state 225 being positioned adjacent to the primary side portion 155 over the bowl 54, see FIG. 1, and the cover 30 has an open operational state 230, see FIG. 2, wherein the cover 30 pivots through an arc 211 of approximately ninety (90) degrees from the closed operational state 225 being about the pivotal axis 210 to form a wind guard for the bowl 30, see FIG. 2.

Continuing, on the smoking pipe apparatus 20, the main storage compartment 64 further comprises a gate 28 that is pivotally attached 194 through a hinge pin 38 to the distal end portion 165, the gate 28 having a gate 28 closed operational state 195, see FIG. 3, that blocks communication from the main storage compartment 64 to the bowl 54 and a gate 28 open operational state 200, see FIG. 7, wherein the gate 28 pivots 196 toward the free portion side 180, again see FIG. 7, facilitating communication from the main storage compartment 64 to the bowl 54, as an example shown in FIG. 13.

Additionally, on the smoking pipe apparatus 20 relating to where the cover 30 is removably engagable to the distal end portion 165 along the pivotal axis 210, see FIGS. 2, 3, and 4, wherein the cover 30 is removed from the distal end portion 165 via moving 215 away axially along the pivotal axis 210 from the distal end portion 165 until the cover 30 is free, see FIG. 4. Wherein the cover 30 is sized and configured 235 to slidably engage 240 the main storage compartment 64 for tobacco 98 to effect sliding movement 245 parallel to the longitudinal axis 135 and the long axis 164 to operationally move the tobacco 98 from the main storage compartment 64 to the bowl 54, when the gate 28 is in the gate 28 open operational state 200, as shown in FIG. 13.

Optionally, on the smoking pipe apparatus 30 relating to the cover 30 that is removably engagable to the distal end portion 165 along the pivotal axis 210, wherein the pivotal attachment 209 is structurally free to selectively be axially movable 215 to facilitate a selectable partial cover 30 for the bowl 54 that is operational to control an area 220 opening as between the bowl interior 59 separated from the exterior environment 160, as shown in FIG. 12.

Further, on the smoking pipe apparatus 20 relating to the elongated body 24 first end portion 140, further comprises the plunger 44 that is slidably received along a sliding axis 205 into a plunger cavity 112 from the first margin 185 wherein the plunger cavity 112 is disposed within the first end portion 140, wherein the plunger cavity 112 is in communication with the secondary storage compartment 62 adjacent to the second margin 190, see FIGS. 15, 16, 18, 19, 22, 23, and 24. Wherein the plunger 44 has a sliding movement axially along said sliding axis 205 that is perpendicular to the longitudinal axis 135, further a means 46 for urging the plunger 44 towards the secondary storage compartment 62 along the sliding axis 205, that is preferably in the form of a spring 46 retained via the plug 48, wherein the plunger 44 is operable to act as a default closure for the secondary storage compartment 62, as best shown in FIGS. 19, 21, and 22.

Continuing, for the smoking pipe apparatus 20, wherein the plunger 44 further comprises the recess 52 that is in communication with the elongated aperture 50 that provides access to the recess 52 from the primary side portion 155, further a tool 32 is inserted therethrough the elongated aperture 50 and is received into the recess 52 to facilitate selective movement of the plunger 44 axially along said sliding axis 205 to operationally selectively open the closure for access to the secondary storage compartment 62, see FIGS. 9, 10, and 19.

CONCLUSION

Accordingly, the present invention of a smoking pipe apparatus 20 has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A smoking pipe apparatus for smoking tobacco, comprising:

(a) an elongated body having a longitudinal axis, said elongated body including a first end portion and an opposing second end portion, said elongated body also including a base side portion and an opposing primary side portion, further said elongated body includes a first margin and an opposing second margin;

(b) a bowl disposed partially within said first end portion from said primary side portion, said bowl including a surrounding sidewall that extends from a step and terminates at said primary side portion, wherein said sidewall defines a bowl interior separated from an exterior environment, said bowl also includes a plurality of chamber voids that are disposed inward from said step toward said base side portion, wherein said plurality of chamber voids inwardly terminate at a centrally disposed ridge that is positioned inward from said step toward said base side portion wherein said ridge is extended toward said primary side portion being positioned between said step and said chamber voids;

(c) a plurality of passageways extending from said second end portion to said plurality of chamber voids, wherein said plurality of passageways are disposed within said elongated body, each of said passageways is in fluid communication with each of said chamber voids; and (d) a screen that is disposed within said sidewall, wherein said screen is supported on an outer periphery by said step and said screen is centrally supported by said ridge, wherein said screen assumes a concave shape as viewed from said primary side portion, wherein operationally when tobacco is placed within said screen concave shape and with an activation of a lighter from said primary side portion adjacent to the tobacco and simultaneously with a manual creation of a vacuum at said plurality of passageways on said second end portion, a diffusion of tobacco smoke is created with said plurality of chamber voids to result in a more centrally outward omnidirectional burn of the tobacco therethrough said screen.

2. A smoking pipe apparatus according to claim 1 further comprising an elongated ancillary body having a long axis, said elongated ancillary body having a distal end portion and an opposing proximal end portion, said elongated ancillary body also including a mating portion side and an opposing free portion side, wherein said primary portion side and said mating portion side are removably engaged to one another being positioned such that said longitudinal axis and said long axis are parallel to one another, said elongated ancillary body further comprising a main storage compartment for tobacco.

3. A smoking pipe apparatus according to claim 2 wherein said elongated ancillary body further comprises a cover for said bowl, wherein said cover is pivotally attached via a pivotal attachment to said distal end portion having a pivotal axis, wherein said pivotal axis is parallel to said longitudinal axis and said long axis, wherein said cover has a closed operational state being positioned adjacent to said primary portion side over said bowl and said cover has an open operational state wherein said cover pivots through an arc of approximately ninety (90) degrees from said closed operational state being about said pivotal axis to form a wind guard for said bowl.

4. A smoking pipe apparatus according to claim 3 wherein said main storage compartment further comprises a gate that is pivotally attached to said distal end portion, said gate having a gate closed operational state that blocks communication from said main storage compartment to said bowl and a gate open operational state wherein said gate pivots toward said free portion side facilitating communication from said main storage compartment to said bowl.

5. A smoking pipe apparatus according to claim 4 wherein said cover is removably engagable to said distal end portion along said pivotal axis, wherein said cover is removed from said distal end portion via moving away axially along said pivotal axis from said distal end portion until said cover is free, wherein said cover is sized and configured to slidably engage said main storage compartment for tobacco to effect sliding movement parallel to said longitudinal axis and said long axis to operationally move the tobacco from said main storage compartment to said bowl when said gate is in said gate open operational state.

6. A smoking pipe apparatus according to claim 3 wherein said cover is removably engagable to said distal end portion along said pivotal axis, wherein said pivotal attachment is structurally free to selectively be axially movable to facilitate a selectable partial cover for said bowl that is operational to control an area opening as between said bowl interior separated from the exterior environment.

7. A smoking pipe apparatus according to claim 1 wherein said elongated body first end portion further comprises a plunger that is slidably received along a sliding axis into a plunger cavity from said first margin wherein said plunger cavity is disposed within said first end portion, said plunger cavity is in communication with a secondary storage compartment adjacent to said second margin, wherein said plunger has a sliding movement axially along said sliding axis that is perpendicular to said longitudinal axis, further a means for urging said plunger towards said secondary storage compartment along said sliding axis, wherein said plunger is operable to act as a default closure for said secondary storage compartment.

8. A smoking pipe apparatus according to claim 7 wherein said plunger further comprises a recess that is in communication with an elongated aperture that provides access to said recess from said primary portion side, further a tool is inserted therethrough said elongated aperture and is received into said recess to facilitate selective movement of said plunger axially along said sliding axis to operationally selectively open said closure for access to said secondary storage compartment.

* * * * *